US008547286B2

(12) United States Patent
Xu et al.

(10) Patent No.: US 8,547,286 B2
(45) Date of Patent: Oct. 1, 2013

(54) METAMATERIAL ANTENNAS FOR WIDEBAND OPERATIONS

(75) Inventors: Nan Xu, Carlsbad, CA (US); Wei Huang, San Diego, CA (US)

(73) Assignee: Tyco Electronics Services GmbH (CH)

( * ) Notice: Subject to any disclaimer, the term of this patent is extended or adjusted under 35 U.S.C. 154(b) by 833 days.

(21) Appl. No.: 12/536,422

(22) Filed: Aug. 5, 2009

(65) Prior Publication Data

US 2010/0045554 A1 Feb. 25, 2010

Related U.S. Application Data

(60) Provisional application No. 61/091,203, filed on Aug. 22, 2008.

(51) Int. Cl.
*H01Q 19/06* (2006.01)
*H01Q 1/38* (2006.01)
*H01Q 15/02* (2006.01)

(52) U.S. Cl.
USPC ..... 343/753; 343/700 MS; 343/909

(58) Field of Classification Search
USPC ..... 343/700 MS, 753, 909
See application file for complete search history.

(56) References Cited

U.S. PATENT DOCUMENTS

| | | | | |
|---|---|---|---|---|
| 5,511,238 | A | 4/1996 | Bayraktaroglu | |
| 6,366,254 | B1 | 4/2002 | Sievenpiper et al. | |
| 6,512,494 | B1 | 1/2003 | Diaz et al. | |
| 6,525,695 | B2 | 2/2003 | McKinzie, III | |
| 6,545,647 | B1 | 4/2003 | Sievenpiper et al. | |
| 6,842,140 | B2 | 1/2005 | Killen et al. | |
| 6,859,114 | B2 | 2/2005 | Eleftheriades et al. | |
| 6,943,731 | B2 | 9/2005 | Killen et al. | |
| 6,950,069 | B2 * | 9/2005 | Gaucher et al. | 343/702 |
| 6,958,729 | B1 | 10/2005 | Metz | |
| 7,215,007 | B2 | 5/2007 | McKinzie, III et al. | |
| 7,256,753 | B2 | 8/2007 | Werner et al. | |
| 7,330,090 | B2 | 2/2008 | Itoh et al. | |
| 7,358,915 | B2 | 4/2008 | Legay et al. | |
| 7,391,288 | B1 * | 6/2008 | Itoh et al. | 333/219 |
| 7,429,961 | B2 | 9/2008 | Sievenpiper et al. | |
| 7,446,712 | B2 | 11/2008 | Itoh et al. | |
| 7,463,213 | B2 | 12/2008 | Nakano et al. | |
| 7,592,957 | B2 * | 9/2009 | Achour et al. | 343/700 MS |
| 7,764,232 | B2 * | 7/2010 | Achour et al. | 343/700 MS |
| 7,911,386 | B1 * | 3/2011 | Itoh et al. | 343/700 MS |
| 7,932,863 | B2 | 4/2011 | Pros et al. | |

(Continued)

FOREIGN PATENT DOCUMENTS

| | | | |
|---|---|---|---|
| KR | 107011754 | B1 | 10/2011 |
| TW | I376838 | B | 11/2012 |

(Continued)

OTHER PUBLICATIONS

Caloz and Itoh, *Electromagnetic Metamaterials: Transmission Line Theory and Microwave Applications*, John Wiley & Sons (2006).

(Continued)

*Primary Examiner* — Michael C Wimer
*Assistant Examiner* — Hasan Islam

(57) ABSTRACT

Metamaterial antennas provide spatially varying electromagnetic coupling that enables impedance matching conditions for different operating frequencies of the MTM antennas so that such antennas can operate at different frequencies for wideband applications, including ultra wideband applications.

21 Claims, 29 Drawing Sheets

(56) References Cited

U.S. PATENT DOCUMENTS

| | | | | |
|---|---|---|---|---|
| 7,952,526 | B2 * | 5/2011 | Lee et al. | 343/700 MS |
| 2003/0011522 | A1 | 1/2003 | McKinzie, III et al. | |
| 2004/0075617 | A1 | 4/2004 | Lynch et al. | |
| 2004/0113848 | A1 | 6/2004 | Gaucher et al. | |
| 2004/0227668 | A1 | 11/2004 | Sievenpiper | |
| 2005/0225492 | A1 | 10/2005 | Metz | |
| 2005/0253667 | A1 | 11/2005 | Itoh et al. | |
| 2007/0176827 | A1 | 8/2007 | Itoh et al. | |
| 2008/0001684 | A1 | 1/2008 | Itoh et al. | |
| 2008/0048917 | A1 | 2/2008 | Achour et al. | |
| 2008/0204327 | A1 | 8/2008 | Lee et al. | |
| 2008/0231521 | A1 | 9/2008 | Anguera Pros et al. | |
| 2008/0258981 | A1 | 10/2008 | Achour et al. | |
| 2009/0128446 | A1 | 5/2009 | Gummalla et al. | |
| 2009/0135087 | A1 | 5/2009 | Gummalla et al. | |

FOREIGN PATENT DOCUMENTS

| | | | |
|---|---|---|---|
| WO | WO-2007098061 | A3 | 8/2007 |
| WO | 2007127955 | | 11/2007 |
| WO | WO-2007127955 | A3 | 11/2007 |
| WO | WO-2009049303 | A1 | 4/2009 |
| WO | WO-2009064926 | A1 | 5/2009 |
| WO | WO-2010021854 | A1 | 2/2010 |

OTHER PUBLICATIONS

Choi, S.H., et al., "A New Ultra-Wideband Antenna for UWB Applications," *Microwave and Optical Technology Letters*, 40(5):399-401, Mar. 2004.

Huang, W., et al., "Composite Right-Left Handed Metamaterial Ultra-Wideband Antenna," *IEEE International Workshop on Antenna Technology* (*iWAT 2009*), 4 pages, Mar. 2-4, 2009.

Itoh, T., "Invited Paper: Prospects for Metamaterials," Electronics Letters, 40(16):972-973, Aug. 2004.

U.S. Appl. No. 61/091,203, filed Aug. 22, 2008, entitled "Metamaterial Antenna Structures with Non-Linear Coupling Geometry" by Gummalla et al.

Herraiz-Martinez, F. J., et al. "Multi-frequency microstrip patch antennas based on metamaterial structures." IEEE Antennas and Propagation Society International Symposium 2007, Jun. 9-15, 2007, Honolulu, HI. pp. 3484-3487.

Wu, C.-H., et al. "A novel small planar antenna utilizing cascaded right/left-handed transmission lines." IEEE Antennas and Propagation Society International Symposium 2007, Jun. 9-15, 2007, Honolulu, HI. pp. 1889-1892.

Lai, A., et al. "Infinite Wavelength Resonant Antennas With Monopolar Radiation Pattern Based on Periodic Structures." IEEE Transactions on Antennas and Propagation, vol. 55, No. 3. Mar. 2007. pp. 868-876.

International Search Report and Written Opinion dated Dec. 31, 2009 for International Application No. PCT/US2009/053044 filed Aug. 6, 2009 (11 pages).

"U.S. Appl. No. 12/250,477, Preliminary Amendment filed Jan. 28, 2009", 15 pgs.

"U.S. Appl. No. 12/270,410, Non Final Office Action mailed May 12, 2011", 20 pgs.

"U.S. Appl. No. 12/270,410, Response filed Mar. 21, 2011 to Restriction Requirement mailed Feb. 17, 2011", 22 pgs.

"U.S. Appl. No. 12/270,410, Restriction Requirement mailed Feb. 17, 2011", 6 pgs.

"International Application Serial No. PCT/US2008/079753, International Search Report mailed Jan. 29, 2009", 3 pgs.

"International Application Serial No. PCT/US2008/079753, International Written Opinion mailed Jan. 29, 2009", 5 pgs.

"International Application Serial No. PCT/US2008/083455, International Search Report and Written Opinion mailed Feb. 27, 2009", 11 pgs.

"International Application Serial No. WO2007127955A2, International Search Report mailed Dec. 31, 2009", 3 pgs.

"International Application Serial No. WO2007127955A2, Written Opinion mailed Dec. 31, 2009", 4 pgs.

"Korean Application Serial No. 2010-7011754, Office Action mailed Jan. 21, 2011", 7 pgs.

"Korean Application Serial No. 2010-7007682, FinalOffice Action mailed Apr. 25, 2011", 5 pgs.

"Korean Application Serial No. 2010-7007682, Office Action mailed Jul. 23, 2010 (English Translation)", 7 pgs.

"Korean Application Serial No. 2010-7011754, Office Action mailed Aug. 18, 2010 (English translation)", 6 pgs.

"Korean Application Serial No. 2010-7011754, Response filed May 23, 2011 to Office Action mailed Jan. 21, 2011", 13 pgs.

"Korean Application Serial No. 2010-7011754, Response filed Oct. 18, 2010 to Office Aaction mailed Aug. 18, 2010 (English translation)", 9 pgs.

"Korean Application Serial No. 2010-7011755, Final Office Action mailed Jan. 21, 2011 (English Translation)", 5 pgs.

"Korean Application Serial No. 2010-7011755, Office Action mailed Aug. 18, 2010 (English Translation)", 8 pgs.

"Korean Application Serial No. 2010-7011755, Response filed Oct. 18, 2010 to Office Action mailed Aug. 18, 2010 (English Translation)", 17 pgs.

Damm, C., et al., "Artificial Line Phase Shifter with separately tunable Phase and Line Impedance", 36th European Microwave Conference, (2006), 423-426.

Horii, Y, et al., "Super Compact Multilayered Left-Handed Transmission Line and Diplexer Application", IEEE Transactions on Microwave Theory and Techniques, 53(4), (Apr. 2005), 1527-1534.

Lee, C, et al., "Design of Resonant Small Antenna Using Composite Right/Left-Handed Transmission Line", IEEE Antennas and Propagation Society Intl. Symposium, (Jul. 2005), 218-221.

Liu, C., et al., "Frequency-Scanned Leaky-Wave Antenna from Negative Refractive Index Transmission Lines", 2nd European Conference on Antennas and Propagation (EuCAP 2007), (Nov. 2007), 4 pgs.

Park, Jae-Hyun, et al., "Compact Spiral Zeroth-order Resonance Antenna using metamaterial transmission line", Journal of the Institute of Electronics Engineers of Korea. TC, Telecommunication, 44(7), University Paper, (2007), 6 pgs.

Pozar, D. M., "Microwave Engineering", 3rd Ed. John Wiley & Sons, (2005), 318-323 & 370.

Sievenpiper, Daniel F., "High-Impedence Electromagnetic Surfaces", Ph.D. Dissertation, University of California, Los Angeles, (1999), 162 pgs.

Simion, S., et al., "CPW Antenna Fabricated on Silicon Substrate, Based on Transmission Line Metamaterial Approach", ICEAA 2007. International Conference on Electromagnetics in Advanced Applications, 2007., 488-491.

Tong, W, et al., "Dual Composite Right/Left-Handed (D-CRLH) Transmission Line in GaAs MMIC Technology", International Workshop on Antenna Technology: Small and Smart Antennas Metamaterials and Applications, 2007. IWAT '07., 105-108.

"U.S. Appl. No. 12/250,477 , Response filed May 15, 2012 to Non Final Office Action mailed Feb. 15, 2012", 19 pgs.

"U.S. Appl. No. 12/250,477 , Response filed Sep. 15, 2011 to Restriction Requirement mailed Aug. 15, 2011", 15 pgs.

"U.S. Appl. No. 12/250,477, Non Final Office Action mailed Feb. 15, 2012", 14 pgs.

"U.S. Appl. No. 12/250,477, Restriction Requirement mailed Aug. 15, 2011", 6 pgs.

"U.S. Appl. No. 12/270,410 , Response filed Feb. 7, 2012 to Final Office Action mailed Nov. 7, 2011", 23 pgs.

"U.S. Appl. No. 12/270,410, Advisory Action mailed Feb. 24, 2012", 4 pgs.

"U.S. Appl. No. 12/270,410, Final Office Action mailed Nov. 7, 2011", 18 pgs.

"U.S. Appl. No. 12/270,410, Response filed Sep. 12, 2011 to Non Final Office Action mailed May 12, 2011", 26 pgs.

"Korean Application Serial No. 2010-7007682, response filed May 25, 2011 to Final Office Action mailed Apr. 25, 2011", 37 pgs.

"Taiwan Application Serial No. 97139201, Office Action mailed Mar. 22, 2012", 13 pgs.

Lai, Anthony, "Infinate Wavelength Resonant Antennas With Monopolar Rapidaton Pattern Based on periodic structures", 9 pgs.

U.S. Appl. No. 12/250,477, Notice of Allowance mailed Mar. 18, 2013, 9 pgs.
U.S. Appl. No. 12/250,477, Notice of Allowance mailed Oct. 2, 2012, 8 pgs.
Chinese Application Serial No. 200880111281.0, Office Action mailed Sep. 10, 2012, 15 pgs.
European Application Serial No. 08838349.2, Office Action mailed Aug. 16, 2012, 1 pg.
European Application Serial No. 08838349.2, Response filed Feb. 22, 2013 to Office Action mailed Aug. 16, 2012, 11 pgs.
European Application Serial No. 08838349.2, Search Report mailed Jul. 30, 2012, 7 pgs.
Korean Application Serial No. 2010-7007682, Office Action mailed Dec. 26, 2012, 7 pgs.
Taiwanese Application Serial No. 97143837, Office Action mailed Sep. 6, 2012, 16 pgs.
Caloz, Christophe, et al., "Array Factor Approach of Leaky-Wave Antennas and Application to 1-D/2-D Composite Right/Left-Handed (CRLH) Structures", IEEE Microwave and Wireless Components Letters, vol. 14 No. 6, (Sep. 2004), 4 pgs.
Kang, M., et al., "Miniaturized MIM CRLH transmission line structure and application to backfire-to-endfire leaky-wave antenna", IEEE Antennas and Propagation Society International Symposium, 2004, vol. 1, (2004), 827-830.
Sanada, A., et al., "A planar zeroth-order resonator antenna using a left-handed transmission line", 34th European Microwave Conference, 2004, vol. 3, (2004), 1341-1344.
Sanada, A., et al., "A via-free microstrip left-handed transmission line", 2004 IEEE MTT-S International Microwave Symposium Digest, vol. 1, (2004), 301-304.
Sato, K., "Composite right/left-handed leaky wave antenna for millimeter-wave automotive applications", First European Conference on Antennas and Propagation, 2006. EuCAP 2006., (2006), 1-4.
Vendik, O. G, et al., "Electronically controlled phase shifters based on right/left-handed transmission lines", 2005 European Microwave Conference, vol. 2, (2005).

* cited by examiner

METAMATERIAL ANTENNAS FOR WIDEBAND OPERATIONS

PRIORITY CLAIM AND RELATED APPLICATION

This patent document claims the benefit of the U.S. Provisional patent application Ser. No. 61/091,203 entitled "Metamaterial Antenna Structures with Non-Linear Coupling Geometry," filed on Aug. 22, 2008. The entire disclosure of the provisional application is incorporated herein by reference.

BACKGROUND

This document relates to metamaterial antenna devices for very wideband operations.

The propagation of electromagnetic waves in most materials obeys the right-hand rule for the (E,H,β) vector fields, where E is the electrical field, H is the magnetic field, and β is the wave vector (or propagation constant). The phase velocity direction is the same as the direction of the signal energy propagation (group velocity) and the refractive index is a positive number. Such materials are "right handed (RH)" materials. Most natural materials are RH materials. Artificial materials can also be RH materials.

A metamaterial (MTM) has an artificial structure. When designed with a structural average unit cell size ρ much smaller than the wavelength of the electromagnetic energy guided by the metamaterial, the metamaterial can behave like a homogeneous medium to the guided electromagnetic energy. Unlike RH materials, a metamaterial can exhibit a negative refractive index, and the phase velocity direction is opposite to the direction of the signal energy propagation where the relative directions of the (E,H,β) vector fields follow the left-hand rule. Metamaterials that support only a negative index of refraction with permittivity ∈ and permeability μ being simultaneously negative are pure "left handed (LH)" metamaterials.

Many metamaterials are mixtures of LH metamaterials and RH materials and thus are Composite Right and Left Handed (CRLH) metamaterials. A CRLH metamaterial can behave like a LH metamaterial at low frequencies and a RH material at high frequencies. Implementations and properties of various CRLH metamaterials are described in, for example, Caloz and Itoh, "Electromagnetic Metamaterials: Transmission Line Theory and Microwave Applications," John Wiley & Sons (2006). CRLH metamaterials and their applications in antennas are described by Tatsuo Itoh in "Invited paper: Prospects for Metamaterials," Electronics Letters, Vol. 40, No. 16 (August, 2004). CRLH metamaterials can be structured and engineered to exhibit electromagnetic properties that are tailored for specific applications and can be used in applications where it may be difficult, impractical or infeasible to use other materials. In addition, CRLH metamaterials may be used to develop new applications and to construct new devices that may not be possible with RH materials.

SUMMARY

MTM antennas described in this document provide spatially varying electromagnetic coupling that enables impedance matching conditions for different operating frequencies of the MTM antennas so that such MTM antennas can operate at different frequencies for wideband applications.

In one aspect, a method for wideband antenna operations based on a composite right and left handed (CRLH) metamaterial antenna structure includes providing an antenna including a CRLH metamaterial structure that includes a cell patch, a launch pad separated from the cell patch by a gap and electromagnetically coupled to the cell patch through the gap to direct a signal to or from the cell patch; structuring the cell patch, the launch pad and the gap to effectuate spatially varying electromagnetic coupling that provides impedance matching for different operating frequencies over a wideband.

In another aspect, an antenna device based on a composite right and left handed (CRLH) metamaterial antenna structure includes a substrate having a first surface and a second surface opposite to the first surface; a cell patch formed on the first surface; and a launch pad formed on the first surface and separated from the cell patch by a gap. The launch pad is electromagnetically coupled to the cell patch through the gap to direct a signal to or from the cell patch. This device includes a feed line formed on the first surface and coupled to the launch pad to conduct the signal to or from the cell patch; a via line formed on the second surface and coupled to a ground electrode outside a footprint of the cell patch on the second surface; and a via formed in the substrate to couple the cell patch on the first surface to the via line on the second surface. The substrate, the feed line, the cell patch, the launch pad, the via line, and the via form a CRLH metamaterial antenna structure. The cell patch, the launch pad and the gap, are structured to effectuate spatially varying electromagnetic coupling that provides impedance matching for different operating frequencies over a wideband.

In yet another aspect, an antenna device based on a composite right and left handed (CRLH) metamaterial antenna structure is provided to include a substrate having a first surface and a second surface opposite to the first surface, and first and second metallization layers formed on the first and second surfaces, respectively. The first and second metallization layers include a cell patch formed on the first surface, a launch pad formed on the first surface and separated from the cell patch by a gap, a feed line formed on the first surface and coupled to the launch pad to conduct an antenna signal to or from the cell patch, a ground electrode formed on the second surface and located outside a footprint of the cell patch projected onto the second surface, a via line formed on the second surface and coupled to the ground electrode on the second surface, and a via formed in the substrate to couple the cell patch on the first surface to the via line on the second surface. The substrate, the feed line, the cell patch, the launch pad, the via line, and the via form a CRLH metamaterial antenna structure that receives the antenna signal from the air or transmits the antennal signal into the air via the cell patch and other parts of the CRLH metamaterial antenna structure. The cell patch, the launch pad and the gap in the first metallization layer are structured to have at least one of a spatial variation in a dimension of the gap along the gap, and a spatial variation in either or both of the cell patch and the launch pad along the gap to effectuate spatially varying electromagnetic coupling that provides impedance matching for different operating frequencies over a wideband.

These and other aspects, and their implementations and variations are described in detail in the attached drawings, the detailed description and the claims.

DETAILED DESCRIPTION

Figure 1:
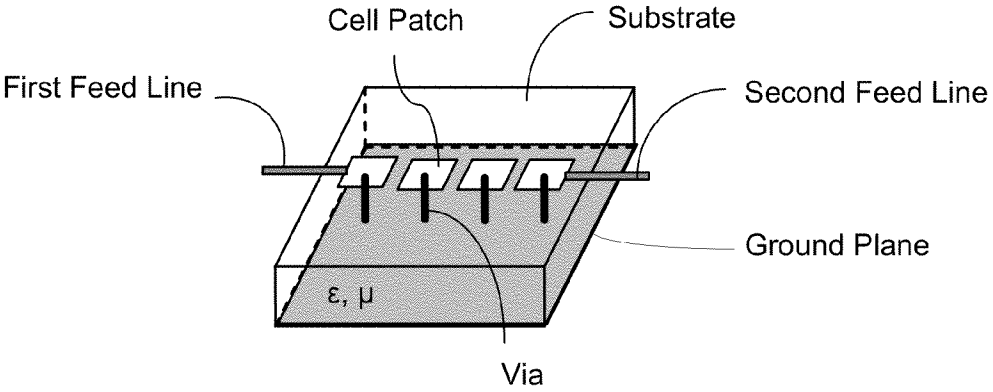
FIG. 1 shows an example of a 1D CRLH MTM TL based on four unit cells.

Metamaterial (MTM) structures can be used to construct antennas, transmission lines and other RF components and devices, allowing for a wide range of technology advancements such as functionality enhancements, size reduction and performance improvements. Examples of MTM antennas described in this document are structured to have spatially varying electromagnetic coupling that provides impedance matching for different operating frequencies over a wideband.

The MTM structures can be implemented based on the CRLH unit cells by using distributed circuit elements, lumped circuit elements or a combination of both. Such MTM structures can be fabricated on various circuit platforms, including circuit boards such as a FR-4 Printed Circuit Board (PCB) or a Flexible Printed Circuit (FPC) board. Examples of other fabrication techniques include thin film fabrication techniques, system on chip (SOC) techniques, low temperature co-fired ceramic (LTCC) techniques, and monolithic microwave integrated circuit (MMIC) techniques.

The MTM antenna structures can be designed for various applications, including cell phone applications, handheld communication device applications (e.g., PDAs and smart phones), WiFi applications, WiMax applications and other wireless mobile device applications, in which the antenna is expected to support multiple frequency bands with adequate performance under limited space constraints. These MTM antenna structures can be adapted and designed to provide one or more advantages over other antennas such as compact sizes, multiple resonances based on a single antenna solution, resonances that are stable and do not shift substantially with the user interaction, and resonant frequencies that are substantially independent of the physical size. Furthermore, elements in such an MTM antenna structure can be configured to achieve desired bands and bandwidths based on the CRLH properties. Some examples of MTM antenna structures are described in the U.S. Patent Applications: Ser. No. 11/741,674 entitled "Antennas, Devices and Systems Based on Metamaterial Structures," filed on Apr. 27, 2007; and Ser. No. 11/844,982 entitled "Antennas Based on Metamaterial Structures," filed on Aug. 24, 2007. The disclosures of the above US patent documents are incorporated herein by reference. Certain aspects of MTM antenna structures are described below.

An MTM antenna or MTM transmission line (TL) has an MTM structure with one or more MTM unit cells. The equivalent circuit for each MTM unit cell includes a right-handed series inductance (LR), a right-handed shunt capacitance (CR), a left-handed series capacitance (CL), and a left-handed shunt inductance (LL). LL and CL are structured and connected to provide the left-handed properties to the unit cell. This type of CRLH TLs or antennas can be implemented by using distributed circuit elements, lumped circuit elements or a combination of both. Each unit cell is smaller than ~$\lambda/4$ where $\lambda$ is the wavelength of the electromagnetic signal that is transmitted in the CRLH TL or antenna.

A pure LH metamaterial follows the left-hand rule for the vector trio (E,H,β), and the phase velocity direction is opposite to the signal energy propagation direction. Both the permittivity ∈ and permeability μ of the LH material are simultaneously negative. A CRLH metamaterial can exhibit both left-handed and right-handed electromagnetic properties depending on the regime or frequency of operation. The CRLH metamaterial can exhibit a non-zero group velocity when the wavevector (or propagation constant) of a signal is zero. In an unbalanced case, there is a bandgap in which electromagnetic wave propagation is forbidden. In a balanced case, the dispersion curve does not show any discontinuity at the transition point of the propagation constant $\beta(\omega_o)=0$ between the left- and right-handed regions, where the guided wavelength is infinite, i.e., $\lambda_g=2\pi/|\beta|\rightarrow\infty$, while the group velocity is positive:

$$v_g = \frac{d\omega}{d\beta}\bigg|_{\beta=0} > 0. \quad \text{Eq. (1)}$$

This state corresponds to the zeroth order mode m=0 in a transmission line (TL) implementation. The CRLH structure supports a fine spectrum of resonant frequencies with the dispersion relation that extends to the negative β region. This allows a physically small device to be built that is electrically large with unique capabilities in manipulating and controlling near-field around the antenna which in turn controls the far-field radiation patterns.

FIG. 1 illustrates an example of a 1-dimensional (1D) CRLH MTM transmission line (TL) based on four unit cells. One unit cell includes a cell patch and a via, and is a building block for constructing a desired MTM structure. The illustrated TL example includes four unit cells formed in two metallization layers of a substrate where four conductive cell patches are formed in the top metallization layer of the substrate, and the other side of the substrate has the bottom metallization layer as the ground plane. Four centered conductive vias are formed to penetrate through the substrate to connect the four cell patches to the ground plane, respectively. The cell patch on the left side is electromagnetically coupled to a first feed line, and the cell patch on the right side is electromagnetically coupled to a second feed line. In some implementations, each cell patch is electromagnetically coupled to an adjacent cell patch without being directly in contact with the adjacent unit cell. This structure forms the MTM transmission line to receive an RF signal from the first feed line and to output the RF signal at the second feed line.

Figure 2:
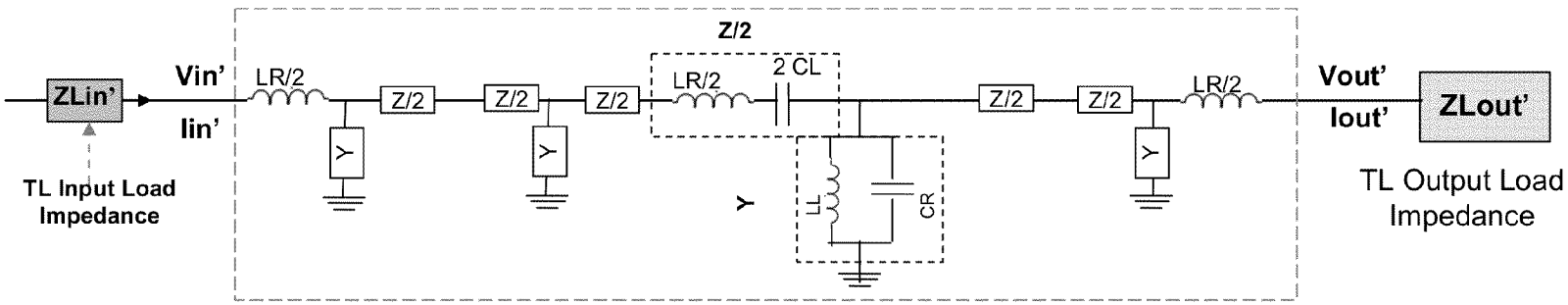
FIG. 2 shows an equivalent circuit of the 1D CRLH MTM TL shown in FIG. 1.

FIG. 2 shows an equivalent network circuit of the 1D CRLH MTM TL in FIG. 1. The ZLin' and ZLout' correspond to the TL input load impedance and TL output load impedance, respectively, and are due to the TL coupling at each end. This is an example of a printed two-layer structure. LR is due to the cell patch on the dielectric substrate, and CR is due to the dielectric substrate being sandwiched between the cell patch and the ground plane. CL is due to the presence of two adjacent cell patches coupled through a coupling gap, and the via induces LL.

Each individual unit cell can have two resonances $\omega_{SE}$ and $\omega_{SH}$ corresponding to the series (SE) impedance Z and shunt (SH) admittance Y. In FIG. 2, the Z/2 block includes a series combination of LR/2 and 2CL, and the Y block includes a parallel combination of LL and CR. The relationships among these parameters are expressed as follows:

$$\omega_{SH} = \frac{1}{\sqrt{LLCR}}; \quad \text{Eq. (2)}$$

$$\omega_{SE} = \frac{1}{\sqrt{LRCL}};$$

$$\omega_R = \frac{1}{\sqrt{LRCR}};$$

$$\omega_L = \frac{1}{\sqrt{LLCL}}$$

$$\text{where, } Z = j\omega LR + \frac{1}{j\omega CL} \text{ and } Y = j\omega CR + \frac{1}{j\omega LL}.$$

The two unit cells at the input/output edges in FIG. 1 do not include CL, since CL represents the capacitance between two adjacent cell patches and is missing at these input/output edges. The absence of the CL portion at the edge unit cells prevents $\omega_{SE}$ frequency from resonating. Therefore, only $\omega_{SH}$ appears as a zeroth order mode (m=0) resonance frequency.

Figure 3:
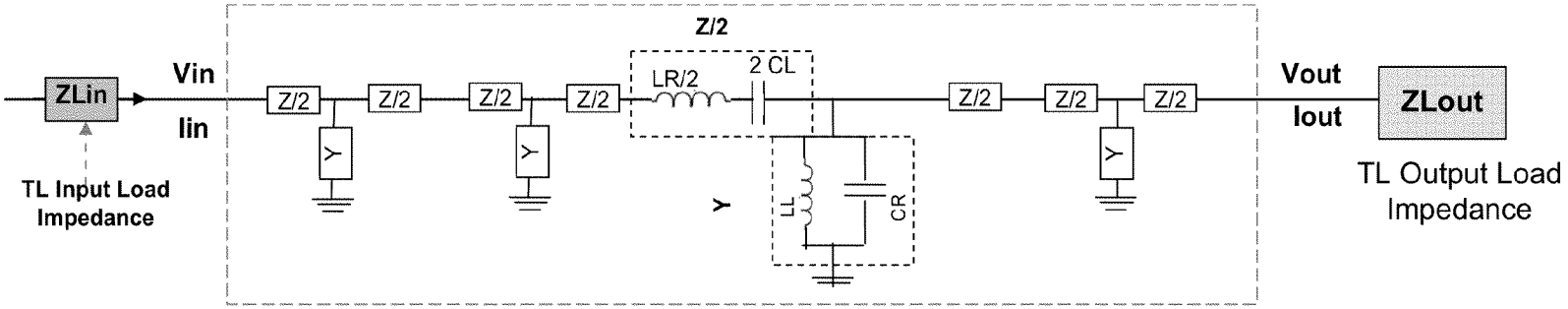
FIG. 3 shows another representation of the equivalent circuit of the 1D CRLH MTM TL shown in FIG. 1.

To simplify the computational analysis, a portion of the ZLin' and ZLout' series capacitor is included to compensate for the missing CL portion, and the remaining input and output load impedances are denoted as ZLin and ZLout, respectively, as seen in FIG. 3. Under this condition, all unit cells have identical parameters as represented by two series Z/2 blocks and one shunt Y block in FIG. 3, where the Z/2 block includes a series combination of LR/2 and 2CL, and the Y block includes a parallel combination of LL and CR.

Figure 4A:
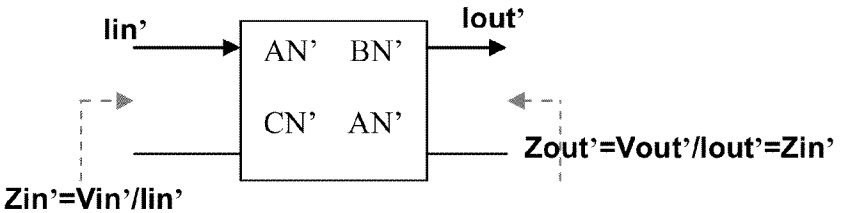
FIG. 4A shows a two-port network matrix representation for the 1D CRLH TL equivalent circuit shown in FIG. 2.
Figure 4B:
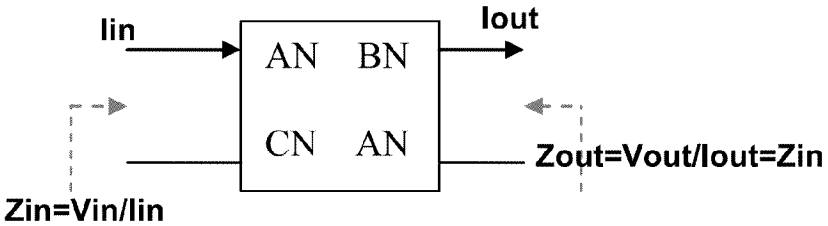
FIG. 4B shows another two-port network matrix representation for the 1D CRLH TL equivalent circuit shown in FIG. 3.
Figure 5:
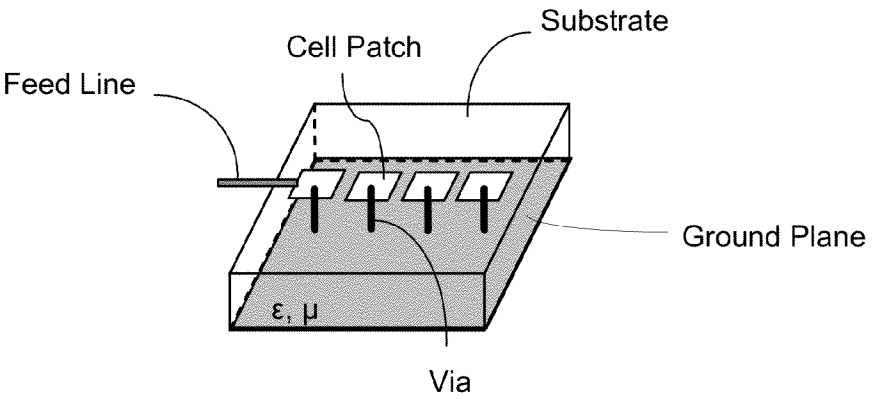
FIG. 5 shows an example of a 1D CRLH MTM antenna based on four unit cells.

FIG. 4A and FIG. 4B illustrate a two-port network matrix representation for the TL without the load impedances as shown in FIG. 2 and FIG. 3, respectively, FIG. 5 illustrates an example of a 1D CRLH MTM antenna based on four unit cells. Different from the 1D CRLH MTM TL in FIG. 1, the antenna in FIG. 5 couples the unit cell on the left side to a feed line to connect the antenna to an antenna circuit and the unit cell on the right side is an open circuit so that the four cells interface with the air to transmit or receive an RF signal.

Figure 6B:
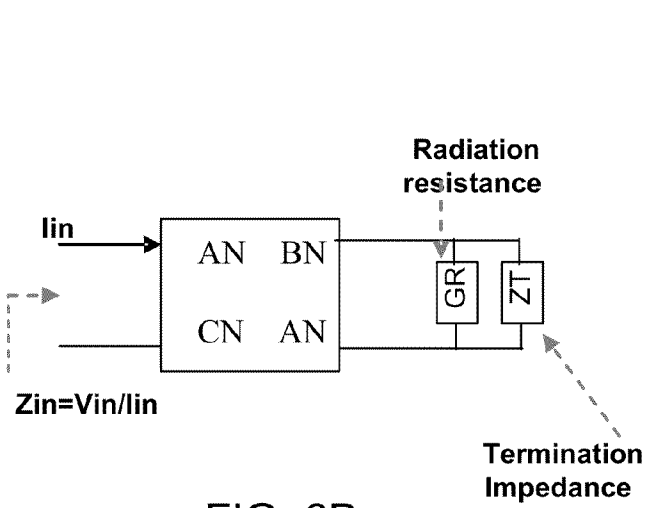
FIG. 6B shows another two-port network matrix representation for the 1D CRLH antenna equivalent circuit analogous to the TL case shown in FIG. 4B.
Figure 6A:
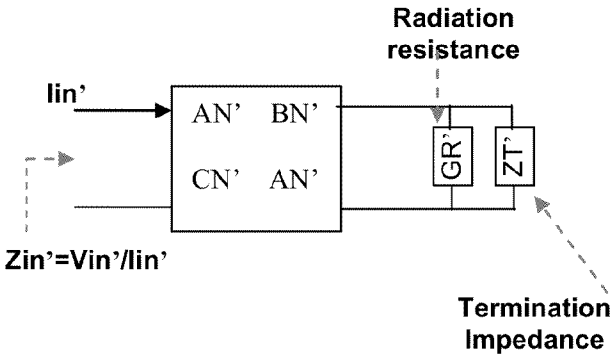
FIG. 6A shows a two-port network matrix representation for the 1D CRLH antenna equivalent circuit analogous to the TL case shown in FIG. 4A.

FIG. 6A shows a two-port network matrix representation for the antenna in FIG. 5. FIG. 6B shows a two-port network matrix representation for the antenna in FIG. 5 with the modification at the edges to account for the missing CL portion to have all the unit cells identical. FIGS. 6A and 6B are analogous to the matrix representations of the TL shown in FIGS. 4A and 4B, respectively.

In matrix notations, FIG. 4B represents the relationship given as below:

$$\begin{pmatrix} Vin \\ Iin \end{pmatrix} = \begin{pmatrix} AN & BN \\ CN & AN \end{pmatrix} \begin{pmatrix} Vout \\ Iout \end{pmatrix}, \quad \text{Eq. (3)}$$

where AN=DN because the CRLH MTM TL in FIG. 3 is symmetric when viewed from Vin and Vout ends.

In FIGS. 6A and 6B, the parameters GR' and GR represent a radiation resistance, and the parameters ZT' and ZT represent a termination impedance. Each of ZT', ZLin' and ZLout' includes a contribution from the additional 2CL as expressed below:

$$ZLin' = ZLin + \frac{2}{j\omega CL}, \quad \text{Eq. (4)}$$

-continued $$ZLout' = ZLout + \frac{2}{j\omega CL},$$

$$ZT' = ZT + \frac{2}{j\omega CL}.$$

Since the radiation resistance GR or GR' can be derived by either building or simulating the antenna, it may be difficult to optimize the antenna design. Therefore, it is preferable to adopt the TL approach and then simulate its corresponding antennas with various terminations ZT. The relationships in Eq. (2) are valid for the TL in FIG. 2 with the modified values AN', BN', and CN', which reflect the missing CL portion at the two edges.

The frequency bands can be determined from the dispersion equation derived by letting the N CRLH cell structure resonate with $n\pi$ propagation phase length, where n=0, ±1, ±2, . . . ±N. Here, each of the N CRLH cells is represented by Z and Y in Eq. (2), which is different from the structure shown in FIG. 2, where CL is missing from end cells. Therefore, one might expect that the resonances associated with these two structures are different. However, extensive calculations show that all resonances are the same except for n=0, where both $\omega_{SE}$ and $\omega_{SH}$ resonate in the structure in FIG. 3, and only $\omega_{SH}$ resonates in the structure in FIG. 2. The positive phase offsets (n>0) correspond to RH region resonances and the negative values (n<0) are associated with LH region resonances.

The dispersion relation of N identical CRLH cells with the Z and Y parameters is given below:

$$\begin{cases} N\beta p = \cos^{-1}(A_N), \Rightarrow |A_N| \le 1 \Rightarrow 0 \le \chi = -ZY \le 4\,\forall\, N \\ \text{where } A_N = 1 \text{ at even resonances } |n| = 2m \in \left\{0, 2, 4, \ldots\ 2\times\mathrm{Int}\left(\frac{N-1}{2}\right)\right\} \\ \text{and } A_N = -1 \text{ at odd resonances} |n| = 2m+1 \in \left\{1, 3, \ldots\ \left(2\times\mathrm{Int}\left(\frac{N}{2}\right)-1\right)\right\} \end{cases} \quad \text{Eq. (5)}$$

where Z and Y are given in Eq. (2), AN is derived from the linear cascade of N identical CRLH unit cells as in FIG. 3, and p is the cell size. Odd n=(2m+1) and even n=2 m resonances are associated with AN=−1 and AN=1, respectively. For AN' in FIG. 4A and FIG. 6A, the n=0 mode resonates at $\omega_0=\omega_{SH}$ only and not at both $\omega_{SE}$ and $\omega_{SH}$ due to the absence of CL at the end cells, regardless of the number of cells. Higher-order frequencies are given by the following equations for the different values of $\chi$ specified in Table 1:

For $n > 0$, Eq. (6)

$$\omega_{\pm n}^2 = \frac{\omega_{SH}^2 + \omega_{SE}^2 + \chi\omega_R^2}{2} \pm \sqrt{\left(\frac{\omega_{SH}^2 + \omega_{SE}^2 + \chi\omega_R^2}{2}\right)^2 - \omega_{SH}^2\omega_{SE}^2}.$$

Table 1 provides $\chi$ values for N=1, 2, 3, and 4. It should be noted that the higher-order resonances |n|>0 are the same regardless if the full CL is present at the edge cells (FIG. 3) or absent (FIG. 2). Furthermore, resonances close to n=0 have small $\chi$ values (near $\chi$ lower bound 0), whereas higher-order resonances tend to reach $\chi$ upper bound 4 as expressed in Eq. (5).

TABLE 1

Resonances for N = 1, 2, 3 and 4 cells

| | Modes | | | |
|---|---|---|---|---|
| N | \|n\| = 0 | \|n\| = 1 | \|n\| = 2 | \|n\| = 3 |
| N = 1 | $\chi_{(1,0)} = 0$; $\omega_0 = \omega_{SH}$ | | | |
| N = 2 | $\chi_{(2,0)} = 0$; $\omega_0 = \omega_{SH}$ | $\chi_{(2,1)} = 2$ | | |
| N = 3 | $\chi_{(3,0)} = 0$; $\omega_0 = \omega_{SH}$ | $\chi_{(3,1)} = 1$ | $\chi_{(3,2)} = 3$ | |
| N = 4 | $\chi_{(4,0)} = 0$; $\omega_0 = \omega_{SH}$ | $\chi_{(4,1)} = 2 - \sqrt{2}$ | $\chi_{(4,2)} = 2$ | |

Figure 7A:
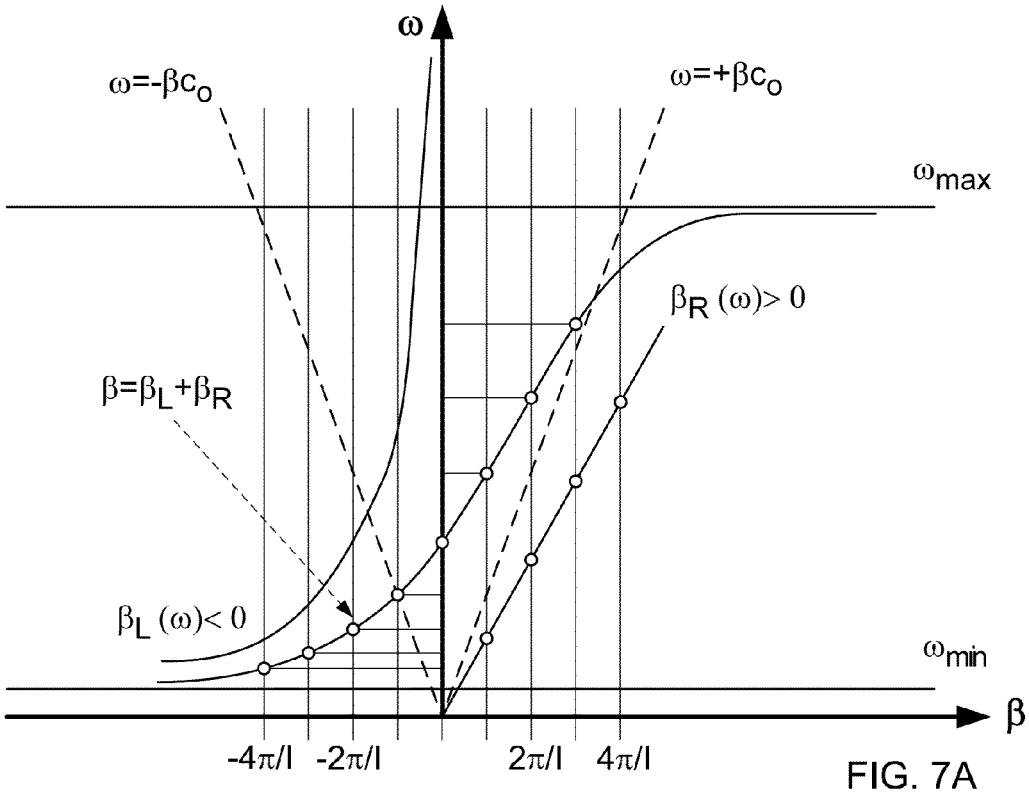
FIG. 7A shows an example of a dispersion curve for the balanced case.
Figure 7B:
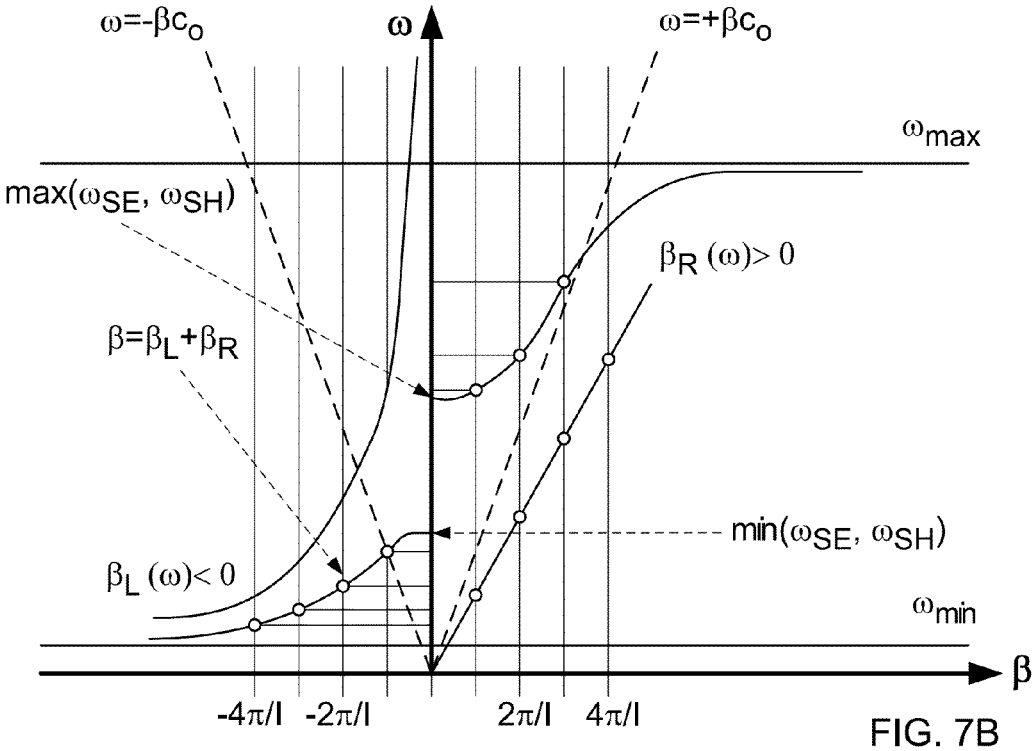
FIG. 7B shows an example of a dispersion curve for the unbalanced case.

The dispersion curve $\beta$ as a function of frequency $\omega$ is illustrated in FIGS. 7A and 7B for the $\omega_{SE}=\omega_{SH}$ (balanced, i.e., LR CL=LL CR) and $\omega_{SE}\neq\omega_{SH}$ (unbalanced) cases, respectively. In the latter case, there is a frequency gap between $\min(\omega_{SE},\omega_{SH})$ and $\max(\omega_{SE},\omega_{SH})$. The limiting frequencies $\omega_{min}$ and $\omega_{max}$ values are given by the same resonance equations in Eq. (6) with $\chi$ reaching its upper bound $\chi$=4 as expressed in the following equations:

$$\omega_{min}^2 = \frac{\omega_{SH}^2 + \omega_{SE}^2 + 4\omega_R^2}{2} - \sqrt{\left(\frac{\omega_{SH}^2 + \omega_{SE}^2 + 4\omega_R^2}{2}\right)^2 - \omega_{SH}^2\omega_{SE}^2} \quad \text{Eq. (7)}$$

$$\omega_{max}^2 = \frac{\omega_{SH}^2 + \omega_{SE}^2 + 4\omega_R^2}{2} + \sqrt{\left(\frac{\omega_{SH}^2 + \omega_{SE}^2 + 4\omega_R^2}{2}\right)^2 - \omega_{SH}^2\omega_{SE}^2}.$$

In addition, FIGS. 7A and 7B provide examples of the resonance position along the dispersion curves. In the RH region (n>0) the structure size 1=Np, where p is the cell size, increases with decreasing frequency. In contrast, in the LH region, lower frequencies are reached with smaller values of Np, hence size reduction. The dispersion curves provide some indication of the bandwidth around these resonances. For instance, LH resonances have the narrow bandwidth because the dispersion curves are almost flat. In the RH region, the bandwidth is wider because the dispersion curves are steeper. Thus, the first condition to obtain broadbands, $1^{st}$ BB condition, can be expressed as follows:

$$COND1\text{: } 1^{st}BB \text{ condition } \left|\frac{d\beta}{d\omega}\right|_{res} = \left|-\frac{\frac{d(AN)}{d\omega}}{\sqrt{(1-AN^2)}}\right|_{res} << 1 \text{ near } \omega = \omega_{res} = \omega_0, \omega_{\pm1}, \omega_{\pm2} \ldots \quad \text{Eq. (8)}$$

$$\Rightarrow \left|\frac{d\beta}{d\omega}\right| = \left|\frac{\frac{d\chi}{d\omega}}{2p\sqrt{\chi\left(1-\frac{\chi}{4}\right)}}\right|_{res} << 1 \text{ with } p = \text{cell size and } \frac{d\chi}{d\omega}\Big|_{res} = \frac{2\omega_{\pm n}}{\omega_R^2}\left(1 - \frac{\omega_{SE}^2\omega_{SH}^2}{\omega_{\pm n}^4}\right),$$

where $\chi$ is given in Eq. (5) and $\omega_R$ is defined in Eq. (2). The dispersion relation in Eq. (5) indicates that resonances occur when $|AN|=1$, which leads to a zero denominator in the $1^{st}$ BB condition (COND1) of Eq. (8). As a reminder, AN is the first transmission matrix entry of the N identical unit cells (FIG. 4B and FIG. 6B). The calculation shows that COND1 is indeed independent of N and given by the second equation in Eq. (8). It is the values of the numerator and $\chi$ at resonances, which are shown in Table 1, that define the slopes of the dispersion curves, and hence possible bandwidths. Targeted structures are at most $Np=\lambda/40$ in size with the bandwidth exceeding 4%. For structures with small cell sizes p, Eq. (8) indicates that high $\omega_R$ values satisfy COND1, i.e., low CR and LR values, since for $n<0$ resonances occur at $\chi$ values near 4 in Table 1, in other terms $(1-\chi/4\rightarrow 0)$.

As previously indicated, once the dispersion curve slopes have steep values, then the next step is to identify suitable matching. Ideal matching impedances have fixed values and may not require large matching network footprints. Here, the word "matching impedance" refers to a feed line and termination in the case of a single side feed such as in antennas. To analyze an input/output matching network, Zin and Zout can be computed for the TL in FIG. 4B. Since the network in FIG. 3 is symmetric, it is straightforward to demonstrate that Zin=Zout. It can be demonstrated that Zin is independent of N as indicated in the equation below:

$$Zin^2 = \frac{BN}{CN} = \frac{B1}{C1} = \frac{Z}{Y}\left(1 - \frac{\chi}{4}\right), \qquad \text{Eq. (9)}$$

which has only positive real values. One reason that B1/C1 is greater than zero is due to the condition of $|AN|\leq 1$ in Eq. (5), which leads to the following impedance condition:

$$0\leq -ZY=\chi\leq 4.$$

The $2^{nd}$ broadband (BB) condition is for Zin to slightly vary with frequency near resonances in order to maintain constant matching. Remember that the real input impedance Zin' includes a contribution from the CL series capacitance as expressed in Eq. (4). The $2^{nd}$ BB condition is given below:

$$COND2\text{: } 2^{ed}BB \text{ condition near resonances, } \left.\frac{dZin}{d\omega}\right|_{near\ res} << 1. \qquad \text{Eq. (10)}$$

Different from the transmission line example in FIG. 2 and FIG. 3, antenna designs have an open-ended side with infinite impedance which poorly matches the structure edge impedance. The capacitance termination is given by the equation below:

$$Z_T = \frac{AN}{CN}, \qquad \text{Eq. (11)}$$

which depends on N and is purely imaginary. Since LH resonances are typically narrower than RH resonances, selected matching values are closer to the ones derived in the $n<0$ region than the $n>0$ region.

One method to increase the bandwidth of LH resonances is to reduce the shunt capacitor CR. This reduction can lead to higher $\omega_R$ values of steeper dispersion curves as explained in Eq. (8). There are various methods of decreasing CR, including but not limited to: 1) increasing substrate thickness, 2) reducing the cell patch area, 3) reducing the ground area under the top cell patch, resulting in a "truncated ground," or combinations of the above techniques.

The MTM TL and antenna structures in FIGS. 1 and 5 use a conductive layer to cover the entire bottom surface of the substrate as the full ground electrode. A truncated ground electrode that has been patterned to expose one or more portions of the substrate surface can be used to reduce the area of the ground electrode to less than that of the full substrate surface. This can increase the resonant bandwidth and tune the resonant frequency. Two examples of a truncated ground structure are discussed with reference to FIGS. 8 and 11, where the amount of the ground electrode in the area in the footprint of a cell patch on the ground electrode side of the substrate has been reduced, and a remaining strip line (via line) is used to connect the via of the cell patch to a main ground outside the footprint of the cell patch. This truncated ground approach may be implemented in various configurations to achieve broadband resonances.

Figure 8:
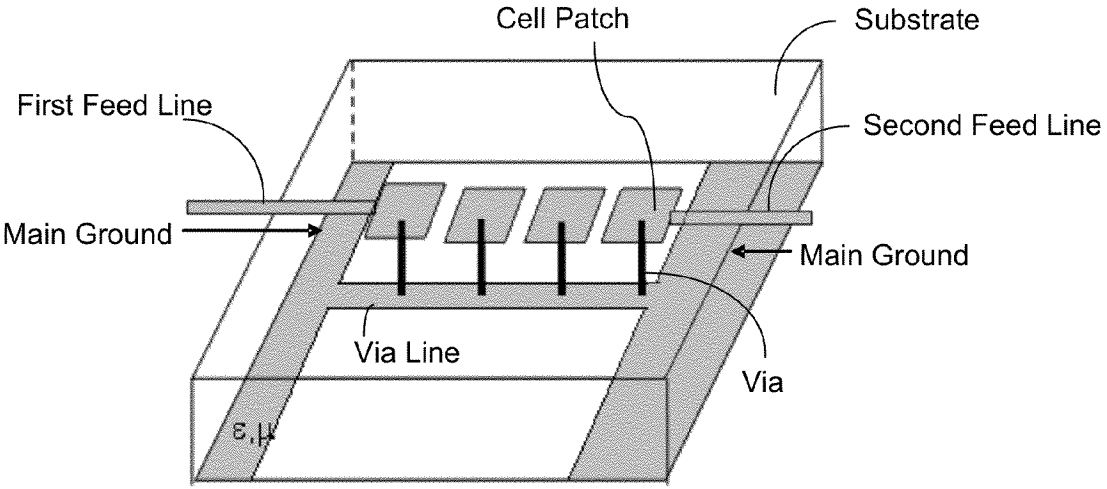
FIG. 8 shows an example of a 1D CRLH MTM TL with a truncated ground based on four unit cells.
Figure 9:
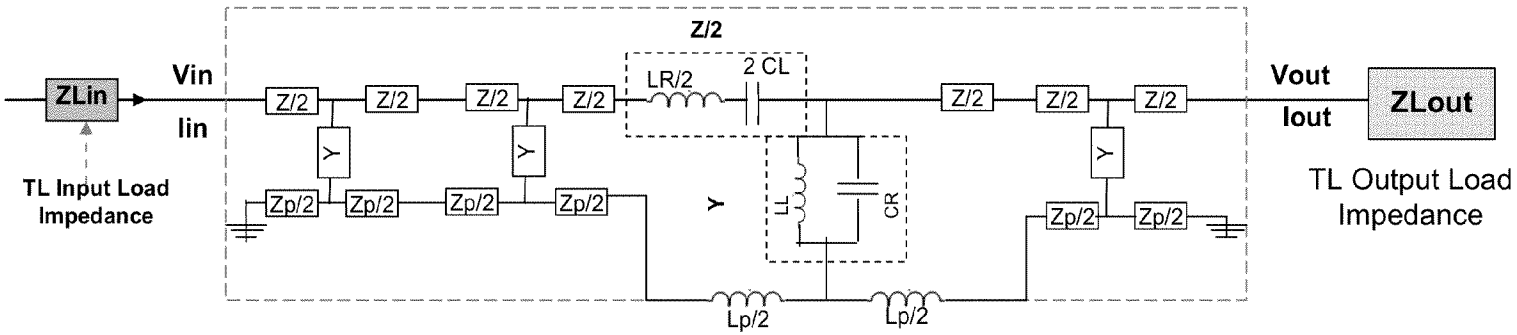
FIG. 9 shows an equivalent circuit of the 1D CRLH MTM TL with the truncated ground shown in FIG. 8.
Figure 10:
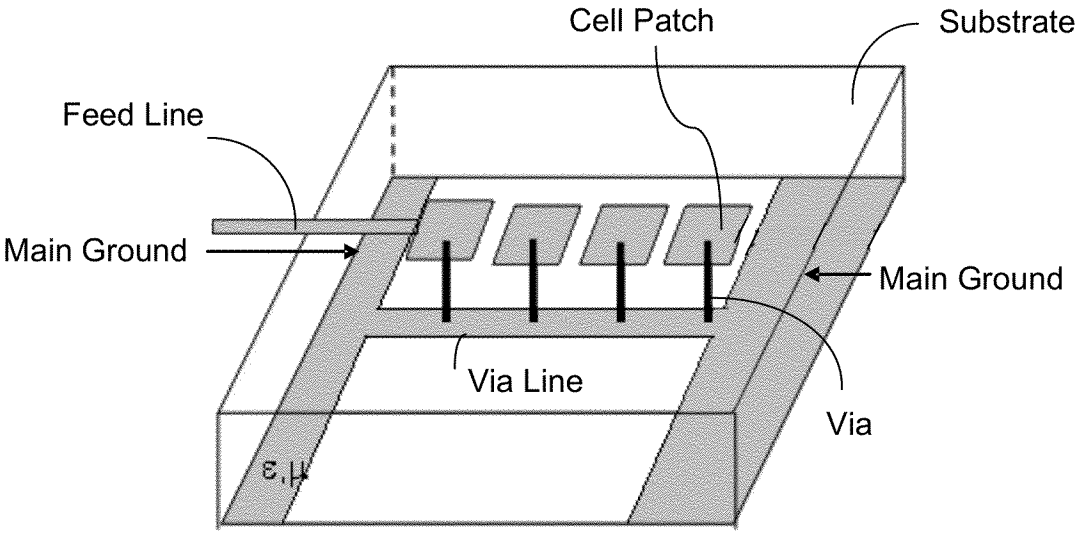
FIG. 10 shows an example of a 1D CRLH MTM antenna with a truncated ground based on four unit cells.

FIG. 8 illustrates one example of a truncated ground electrode for a four-cell MTM transmission line where the ground electrode has a dimension that is less than the cell patch along one direction underneath the cell patch. The bottom metallization layer includes a via line that is connected to the vias and passes through underneath the cell patches. The via line has a width that is less than a dimension of the cell path of each unit cell. The use of a truncated ground may be a preferred choice over other methods in implementations of commercial devices where the substrate thickness cannot be increased or the cell patch area cannot be reduced because of the associated decrease in antenna efficiencies. When the ground is truncated, another inductor Lp (FIG. 9) is introduced by the metallization strip (via line) that connects the vias to the main ground as illustrated in FIG. 8. FIG. 10 shows a four-cell antenna counterpart with the truncated ground analogous to the TL structure in FIG. 8.

Figure 11:
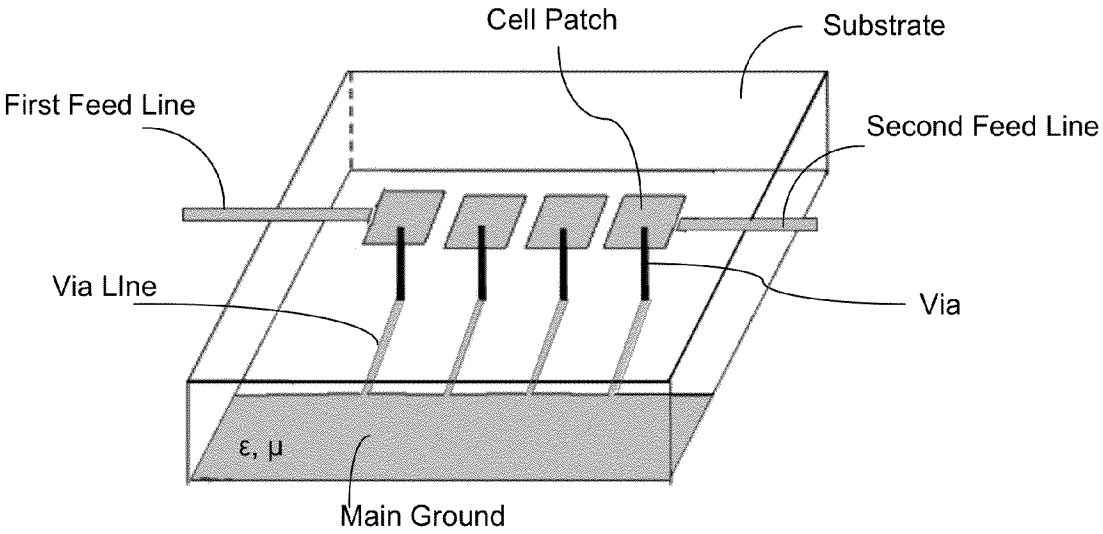
FIG. 11 shows another example of a 1D CRLH MTM TL with a truncated ground based on four unit cells.

FIG. 11 illustrates another example of an MTM antenna having a truncated ground. In this example, the bottom metallization layer includes via lines and a main ground that is formed outside the footprint of the cell patches. Each via line is connected to the main ground at a first distal end and is connected to the via at a second distal end. The via line has a width that is less than a dimension of the cell path of each unit cell.

The equations for the truncated ground structure can be derived. In the truncated ground examples, the shunt capacitance CR becomes small, and the resonances follow the same equations as in Eqs. (2), (6) and (7) and Table 1. Two approaches are presented below. FIGS. 8 and 9 represent the first approach, Approach 1, wherein the resonances are the same as in Eqs. (2), (6) and (7) and Table 1 after replacing LR by (LR+Lp). For $|n|\neq 0$, each mode has two resonances corresponding to (1) $\omega_{\pm n}$ for LR being replaced by (LR+Lp) and (2) $\omega_{\pm n}$ for LR being replaced by (LR+Lp/N) where N is the number of unit cells. Under this Approach 1, the impedance equation becomes:

$$Zin^2 = \frac{BN}{CN} = \frac{B1}{C1} = \frac{Z}{Y}\left(1 - \frac{\chi + \chi_P}{4}\right)\frac{(1 - \chi - \chi_P)}{(1 - \chi - \chi_P/N)}, \qquad \text{Eq. (12)}$$

$$\text{where } \chi = -YZ \text{ and } \chi_P = -YZ_P,$$

where $Zp=j\omega Lp$ and Z, Y are defined in Eq. (2). The impedance equation in Eq. (12) provides that the two resonances $\omega$ and $\omega'$ have low and high impedances, respectively. Thus, it is easy to tune near the $\omega$ resonance in most cases.

Figure 12:
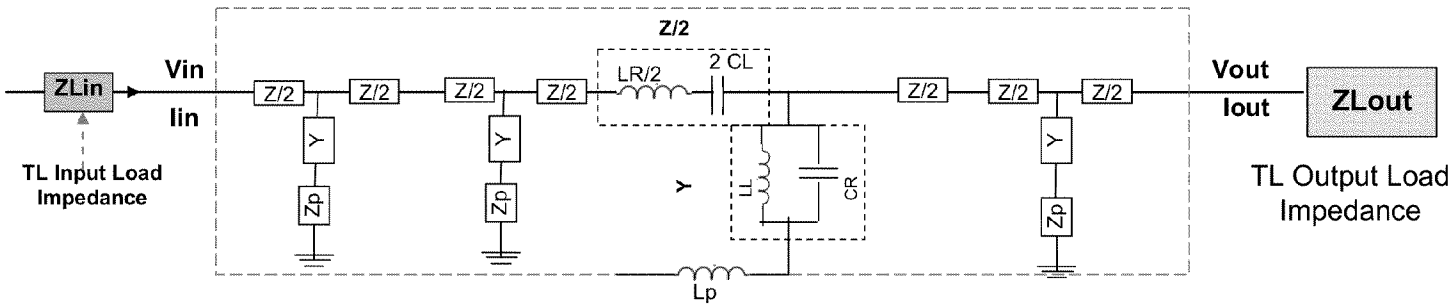
FIG. 12 shows an equivalent circuit of the 1D CRLH MTM TL with the truncated ground shown in FIG. 11.

The second approach, Approach 2, is illustrated in FIGS. 11 and 12 and the resonances are the same as in Eqs. (2), (6), and (7) and Table 1 after replacing LL by (LL+Lp). In the second approach, the combined shunt inductor (LL+Lp) increases while the shunt capacitor CR decreases, which leads to lower LH frequencies.

The above exemplary MTM structures are formed in two metallization layers, and one of the two metallization layers is used to include the ground electrode and is connected to the other metallization layer by conductive vias. Such two-layer CRLH MTM TLs and antennas with vias can be constructed with a full ground as shown in FIGS. 1 and 5 or a truncated ground as shown in FIGS. 8, 10 and 11.

A multilayer MTM antenna structure has conductive parts, including a ground, in two or more metallization layers which are connected by at least one via. The examples and implementations of such multilayer MTM antenna structures are described in the U.S. patent application Ser. No. 12/270,410 entitled "Metamaterial Structures with Multilayer Metallization and Via," filed on Nov. 13, 2008, the disclosure of which is incorporated herein by reference as part of this specification. These multiple metallization layers are patterned to have multiple conductive parts based on a substrate, a film or a plate structure where two adjacent metallization layers are separated by an electrically insulating material (e.g., a dielectric material). Two or more substrates may be stacked together with or without a dielectric spacer to provide multiple surfaces for the multiple metallization layers to achieve certain technical features or advantages. Such multilayer MTM structures may have at least one conductive via to connect one conductive part in one metallization layer to another conductive part in another metallization layer.

An exemplary implementation of a double-layer metallization (DLM) MTM structure includes a substrate having a first surface and a second surface opposite to the first surface, a first metallization layer formed on the first surface, and a second metallization layer formed on the second surface, where the two metallization layers are patterned to have two or more conductive parts with at least one conductive via connecting one conductive part in the first metallization layer to another conductive part in the second metallization layer. The conductive parts in the first metallization layer include a cell patch of the DLM MTM structure and a feed line that is electromagnetically coupled to the cell patch without being directly in contact with the cell patch. The conductive parts in the second metallization layer include a via line that interconnects a ground and the cell patch through a via formed in the substrate. An additional conductive line, such as a meander line, can be added to the feed line to induce a monopole resonance to obtain a broadband or multiband antenna operation.

The MTM antenna structures can be configured to support multiple frequency bands including a "low band" and a "high band." The low band includes at least one left-handed (LH) mode resonance and the high band includes at least one right-handed (RH) mode resonance. These MTM antenna structures can be implemented to use a LH mode to excite and better match the low frequency resonances as well as to improve impedance matching at high frequency resonances. Examples of various frequency bands that can be supported by MTM antennas include frequency bands for cell phone and mobile device applications, WiFi applications, WiMax applications and other wireless communication applications. Examples of the frequency bands for cell phone and mobile device applications are: the cellular band (824-960 MHz) which includes two bands, CDMA (824-894 MHz) and GSM (880-960 MHz) bands; and the PCS/DCS band (1710-2170 MHz) which includes three bands, DCS (1710-1880 MHz), PCS (1850-1990 MHz) and AWS/WCDMA (2110-2170 MHz) bands. A quad-band antenna can be used to cover one of the CDMA and GSM bands in the cellular band (low band) and all three bands in the PCS/DCS band (high band). A penta-band antenna can be used to cover all five bands with two in the cellular band (low band) and three in the PCS/DCS band (high band). Note that the WWAN band refers to these five bands ranging from 824 MHz to 2170 MHz when applied for laptop wireless communications. Examples of frequency bands for WiFi applications include two bands: one ranging from 2.4 to 2.48 GHz (low band), and the other ranging from 5.15 GHz to 5.835 GHz (high band). The frequency bands for WiMax applications involve three bands: 2.3-2.4 GHZ, 2.5-2.7 GHZ, and 3.5-3.8 GHz. An exemplary frequency band for Long Term Evolution (LTE) applications includes the range of 746-796 MHz. An exemplary frequency band for GPS applications includes 1.575 GHz. An exemplary frequency band for Wireless Personal Area Network (WPAN) covers 3 GHz-8 GHz, which represents an example of the ultra wideband (UWB) which covers 3 GHz to 10.6 GHz.

A MTM antenna structure can be specifically tailored to comply with requirements of an application, such as PCB real-estate factors, device performance requirements and other specifications. The cell patch in the MTM structure can have a variety of geometrical shapes and dimensions, including, for example, rectangular, polygonal, irregular, circular, oval, or combinations of different shapes. The via line and the feed line can also have a variety of geometrical shapes and dimensions, including, for example, rectangular, polygonal, irregular, zigzag, spiral, meander or combinations of different shapes. The distal end of the feed line can be modified to form a launch pad to modify the electromagnetic coupling to the cell patch. The launch pad can have a variety of geometrical shapes and dimensions, including, e.g., rectangular, polygonal, irregular, circular, oval, or combinations of different shapes. The gap between the launch pad and cell patch can take a variety of forms, including, for example, straight line, curved line, L-shaped line, zigzag line, discontinuous line, enclosing line, or combinations of different forms. Some of the feed line, launch pad, cell patch and via line can be formed in different layers from the others. Some of the feed line, launch pad, cell patch and via line can be extended from one metallization layer to a different metallization layer. The antenna portion can be placed a few millimeters above the main substrate. Multiple cells may be cascaded in series to form a multi-cell 1D structure. Multiple cells may be cascaded in orthogonal directions to form a 2D structure. In some implementations, a single feed line may be configured to deliver power to multiple cell patches. In other implementations, an additional conductive line may be added to the feed line or launch pad, in which this additional conductive line can have a variety of geometrical shapes and dimensions, including, for example, rectangular, irregular, zigzag, spiral, meander, or combinations of different shapes. The additional conductive line can be placed in the top, mid or bottom layer, or a few millimeters above the substrate.

A conventional dipole antenna, for example, has a size of about one half of one wavelength for the RF signal at an antenna resonant frequency and thus requires a relatively large real estate for RF frequencies used in various wireless communication systems. MTM antennas can be structured to have a compact and small size while providing the capability to support multiple frequency bands.

The MTM antennas described in this document are designed for wideband operations, e.g., ultra wideband (UWB) and other wireless communications. The UWB technology has been recognized as one of the promising solutions for short range wireless communications because of the capability of providing ultra high data rate with low power consumption. UWB antennas are often specified to have a compact size while maintaining a ultra-wide bandwidth with stable efficiency over the band, so that they can be integrated in a small-size device with the presence of other multiple antennas. Exemplary implementations of MTM antenna structures that are compact in size and can support UWB operations, such as the WPAN operation ranging from 3 GHz to 8 GHz, are described below.

FIGS. 13A-13D show an example of an MTM antenna formed on a substrate and designed for wideband operations, illustrating the top view of the top layer, top view of the bottom layer, side view and 3D view, respectively. In the Cartesian coordinate system shown, the top and bottom surfaces of the substrate are in the X-Y plane and are displaced from each other along the Z axis. This MTM antenna structure is an example of a DLM MTM structure, which includes a substrate 1300 having a first surface and a second surface opposite to the first surface, a first metallization layer (top layer) 1301 formed on the first surface, and a second metallization layer (bottom layer) 1302 formed on the second surface, where the two metallization layers 1301 and 1302 are patterned to have two or more conductive parts. At least one conductive via 1320 is formed in the substrate 1300 and connects one conductive part in the first metallization layer 1301 to another conductive part in the second metallization layer 1302. These conductive parts include a feed line 1304, a launch pad 1308, a cell patch 1312, a via pad 1324 and a via line 1328 in this particular exemplary MTM antenna structure shown in FIGS. 13A-13D.

The cell patch 1312 is a part of the RF transmitting and receiving structure of the MTM antenna that receives an RF signal from the air or transmits an RF signal into the air. The feed line 1304 has one end in communication with an antenna circuit that generates and supplies an RF signal to be transmitted out by the MTM antenna, or receives and processes an RF signal received by the MTM antenna. The other end of the feed line 1304 is connected to the launch pad 1308 to conduct the RF signal to or from the launch pad 1308. The launch pad 1308 is spaced from the cell patch 1312 by a gap 1316 and is electromagnetically coupled to the cell patch 1312 via the gap 1316 to conduct the RF signal. For this reason, the gap 1316 is a coupling gap.

The electromagnetic coupling via the coupling gap 1316 is collectively dictated by various factors, primarily the geometry and dimensions of the coupling gap 1316, the geometry and dimensions of the cell patch 1312 and the geometry and dimensions of the launch pad 1308. The electromagnetic coupling via the coupling gap 1316 can affect the impedance matching of the MTM antenna. The MTM antennas described in this document are structured to effectuate spatially varying electromagnetic coupling at different locations of the coupling gap 1316 to provide desired impedance matching for various operating frequencies over a wideband.

In the specific example in FIGS. 13A-13D, the end of the feed line 1304 that is not connected to the launch pad 1308 can be configured to connect to a CPW feed which is, in turn, in communication with the antenna circuit. The CPW feed can be formed in a top ground plane that is formed in the top layer, separated from the conductive parts and paired with a bottom ground plane, which is formed in the bottom layer, below the top ground plane and separated from the via pad 1320 and outside the footprint of the cell patch 1312. Alternatively, the MTM antenna can be fed with a CPW feed that does not require a ground plane on a different layer, a probed patch or a cable connector. The other end of the feed line 1304 is connected to the launch pad 1308 to direct a signal to or receive a signal from the cell patch 1312 through the coupling gap 1316. The via 1320 is formed in the substrate 1300 to connect the cell patch 1312 in the top layer 1301 to the via pad 1324 in the bottom layer 1302. The via line 1328 is formed in the bottom layer to connect the via pad 1324, hence the via 1320 and the cell patch 1312, to the bottom ground plane. These conductive parts and the substrate together form an MTM antenna structure with the CRLH properties.

Figure 13A:
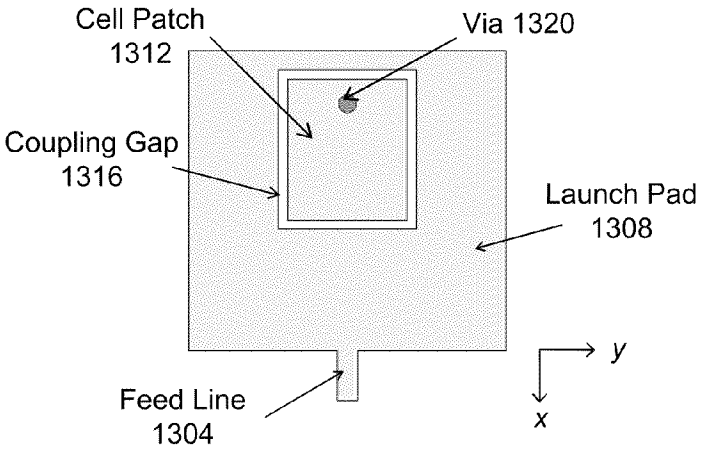
FIGS. 13A-13D show an example of an MTM antenna designed for very wideband operations, illustrating the top view of the top layer, top view of the bottom layer, side view and 3D view, respectively.
Figure 13C:
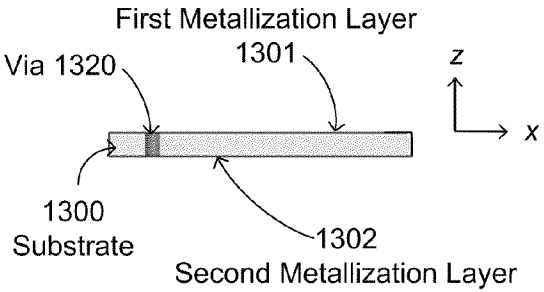
Figure 13B:
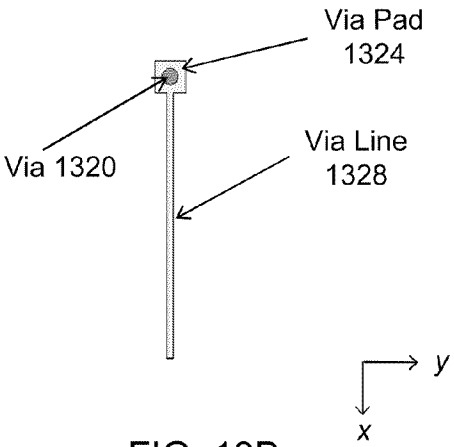
Figure 13D:
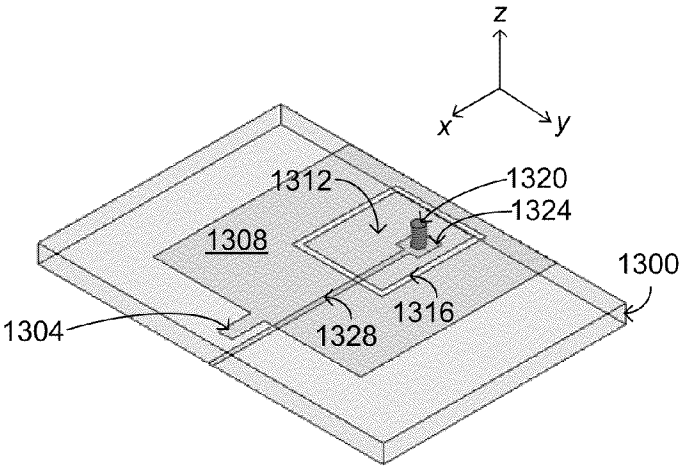

Referring to FIGS. 13A and 13D, the launch pad 1308 is generally rectangular in shape and has an inner rectangular opening in which the launch pad 1312 is located. The cell patch 1312 is also rectangular in shape and is enclosed within the launch pad 1308. The coupling gap 1316 is thus non-linear in shape and surrounds the cell patch 1312. In this example, the MTM antenna is designed to provide spatially varying electromagnetic coupling via the coupling gap 1316 to allow for impedance matching at different frequencies over a wideband. The width of the coupling gap 1315 varies and changes from each corner of the cell patch 1312 to each side of the cell patch 1312. The dimensions of the launch pad 1308 along the coupling gap 1316 also varies, e.g., the top part of launch pad 1308 outside the coupling gap 1316 has an area smaller than the area of each of other three sides of the launch pad. This is an example of using a combination of spatial variations in both the coupling gap 1316 and the adjacent areas of the launch pad 1308 to provide spatially varying electromagnetic coupling via the coupling gap 1316. The spatial variations are designed to create desired impedance matching at different operating frequencies. In other implementations, either the coupling gap 1316 or the adjacent areas of the launch pad 1308 may be structured to provide spatial variations to achieve desired spatially varying electromagnetic coupling. In general, the cell patch 1312, the launch pad 1308 and the gap 1316 can be structured to effectuate spatially varying electromagnetic coupling that provide impedance matching for different operating frequencies over a wideband.

In addition to the above spatial variations in the coupling gap and the launch pad along the coupling gap, the cell patch can also be structured to provide a spatial variation along the coupling gap to achieve desired spatially varying electromagnetic coupling for wideband operations. Therefore, the cell patch, the launch pad and the gap, which are formed in the same metallization layer on one side of the substrate, can be structured in their dimensions and shapes to have at least one of (1) a spatial variation in a dimension of the gap along the gap, and (2) a spatial variation in either or both of the cell patch and the launch pad along the gap, to effectuate desired spatially varying electromagnetic coupling that provides impedance matching for different operating frequencies over a wideband. The above example shows a rectangular cell patch inside a rectangular opening within the launch pad. Other examples of cell patches are triangular, full and semi circular, full and semi elliptical, polygonal and square shapes and combinations of two or more different shapes. If a non-rectangular cell patch is placed inside the rectangular opening of the launch pad shown in FIG. 13A, a spatially varying gap is formed between the cell patch and the launch pad to provide spatially varying electromagnetic coupling. The width and shape of the coupling gap can be controlled by the design of the cell patch to achieve desired spatially varying electromagnetic coupling for impedance matching for selected operating frequencies over a given wideband.

Figure 14B:
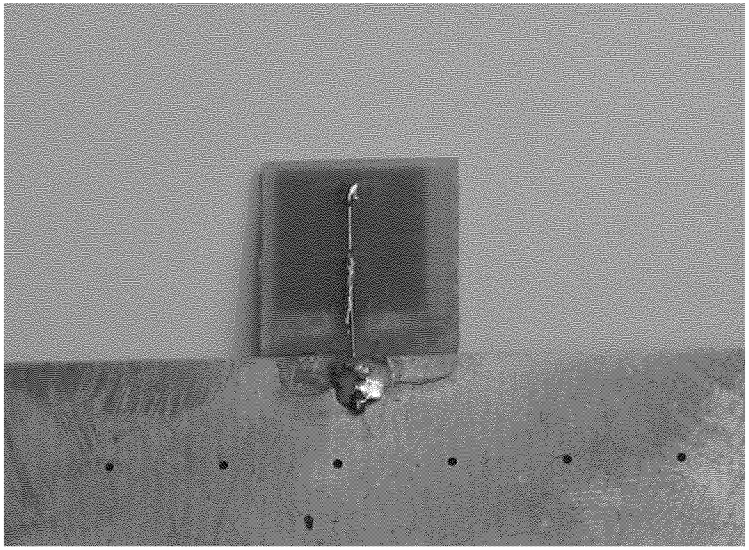
FIGS. 14A and 14B show the photos of a sample of the MTM antenna shown in FIGS. 13A-13D, showing the top view of the top layer and bottom view of the bottom layer, respectively.
Figure 14A:
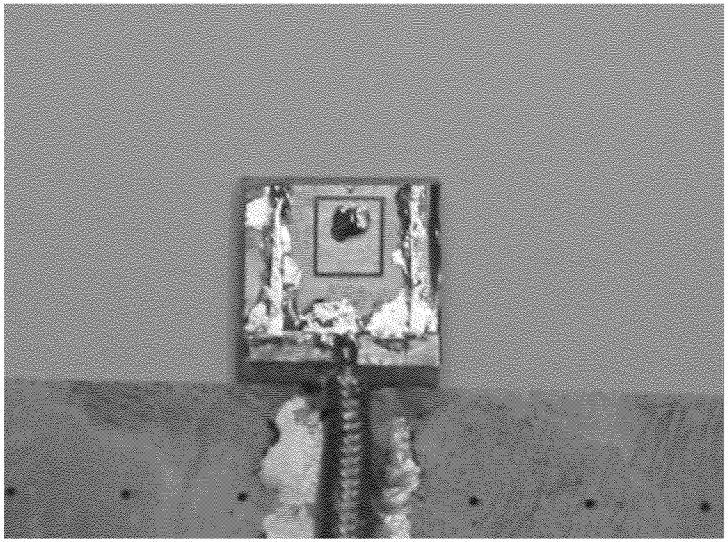

FIGS. 14A and 14B show photos of a sample MTM antenna based on the design shown in FIGS. 13A-13D, showing the top view of the top layer and bottom view of the bottom layer, respectively. This antenna is mounted on a ground plane with the size of 80 mm×50 mm and fed by use of a coaxial cable. The design parameters for fabricating this MTM antenna are as follows. The substrate is FR-4 with permittivity of 4.4 and thickness of 1 mm. The overall size of the MTM antenna is 10.5 mm×9 mm. The feed line 1304 has 1.4 mm in length and 0.6 mm in width. The launch pad 1308 is shaped as a rectangular loop with outer dimensions of 8.5 mm×9 mm and inner dimensions of 4.508 mm×3.908 mm. The cell patch 1312 is surrounded by the launch pad 1308, with a coupling gap 1316 having a width of 0.25 mm. The cell patch 1312 has a rectangular shape with dimensions of 4 mm×3.4 mm. The via line 1328 is 8.5 mm long in total and has a width of 0.2 mm. The via pad 1324 is square with a side length of 1 mm. The structures in the top and bottom layers are interchangeable.

Figure 15A:
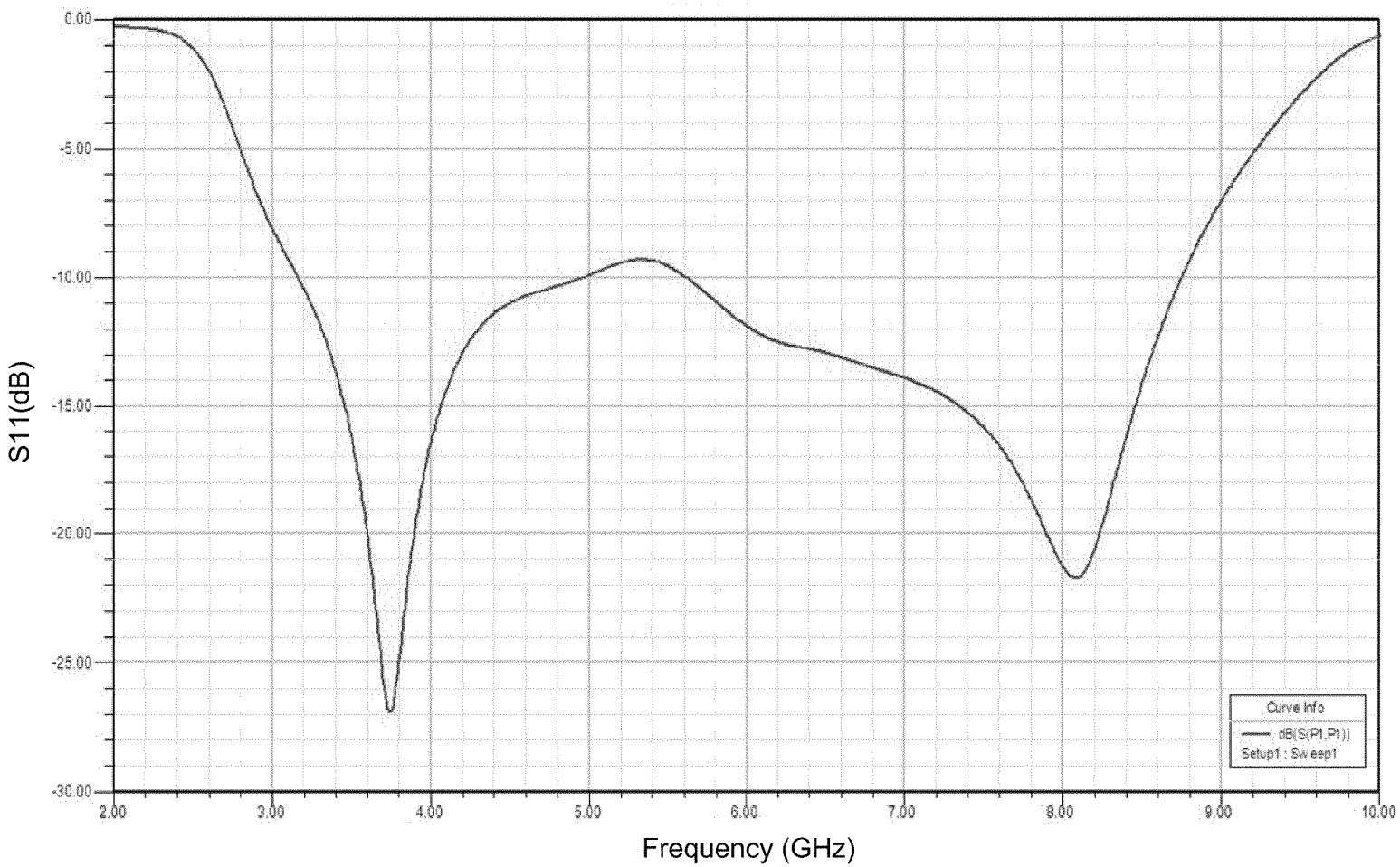
FIGS. 15A and 15B show the simulated return loss and measured return loss, respectively, of the MTM antenna shown in FIGS. 13-14.
Figure 15B:
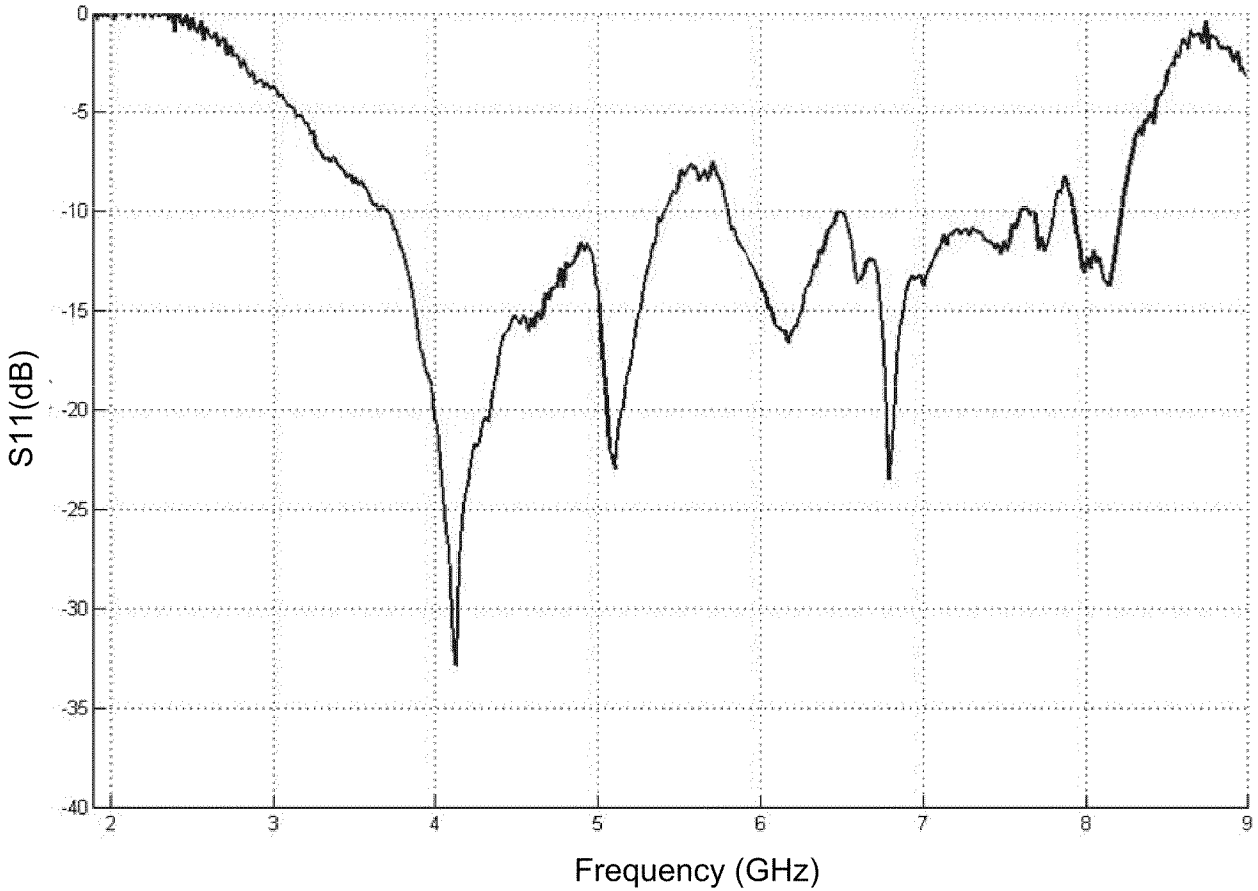

FIGS. 15A and 15B show the simulated return loss and measured return loss, respectively, of the MTM antenna shown in FIGS. 13-14. It can be seen that this antenna radiates efficiently from about 3 GHz to about 9 GHZ, exhibiting the return loss close to or better than −10 dB for this wide frequency range. Thus, this MTM antenna structure provides the capability suitable for UWB operations, in particular, for the WPAN operation in the spectral range from 3 GHz to 8 GHz.

The analysis using the CRLH unit cells indicates that the electromagnetic coupling between the cell patch 1312 and the launch pad 1308 for the MTM antenna in FIGS. 13A-13D contributes to the LH series capacitance (CL). The spatial variation of the coupling gap 1316 realized by the present structure, in which the cell patch 1312 is surrounded by the launch pad 1308 with the surrounding coupling gap 1316 in between, provides the spatial variation of the electromagnetic coupling. Matching is determined by the impedance expressed as in Eq. (2), in which the CL term is dominant in the low frequency region. Unlike a structure with a linear coupling geometry with a fixed gap width, where the electromagnetic coupling does not vary spatially, the CL value is frequency dependent due to the spatially varying coupling in the present MTM structure. Specifically, as the frequency changes, the region of the effective coupling in the structure changes, thereby providing different but finite CL values at different frequencies. This indicates enhancement of impedance matching over a frequency range wider than that with a linear coupling geometry with a fixed gap width. The low band including the LH resonance is thus broadened, and together with the high band including the RH resonance (mono-pole type resonance) gives rise to good matching over a very wideband with a bandwidth ranging from 5 to 8 GHz, for example.

Figure 16A:
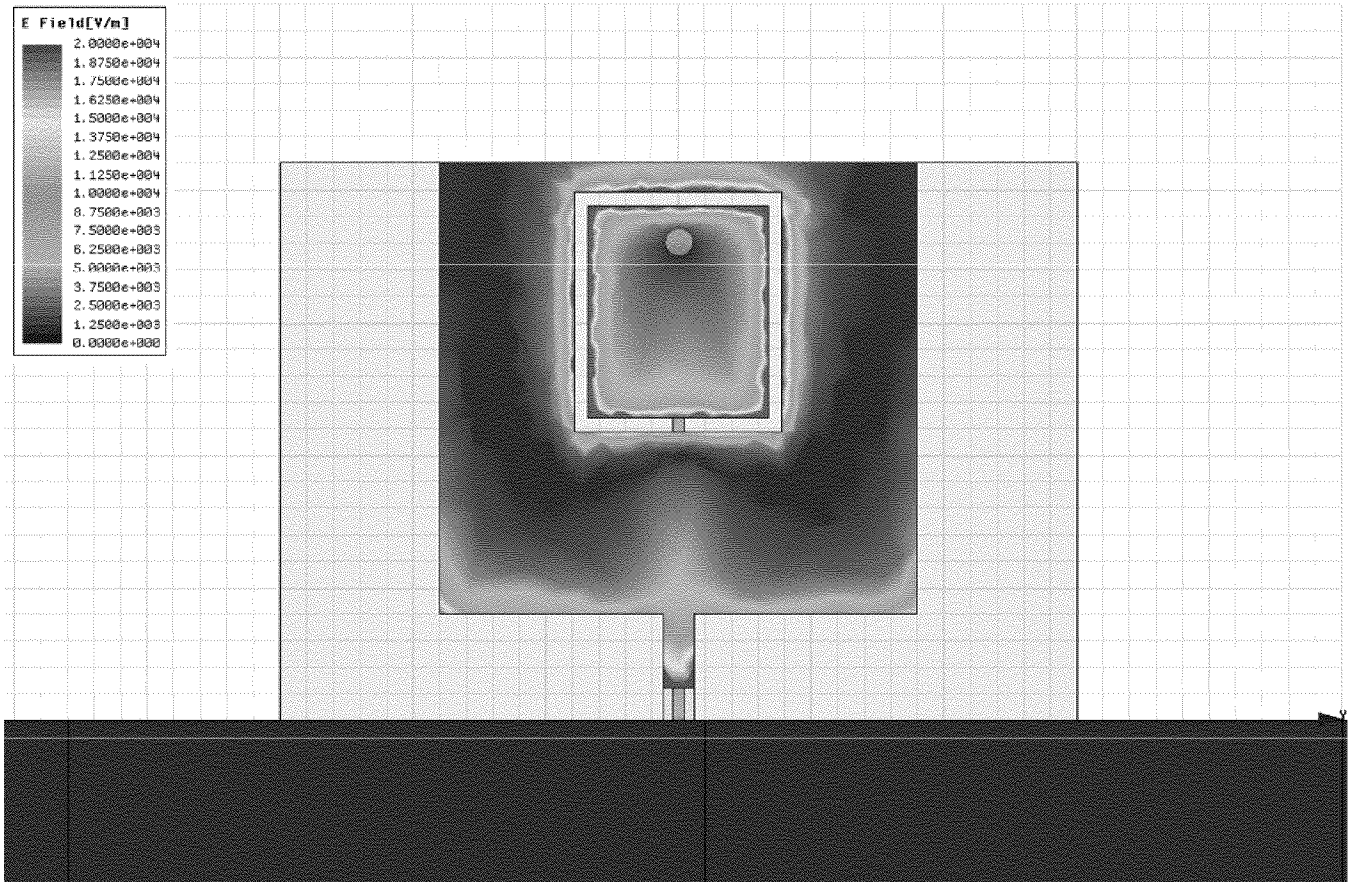
FIGS. 16A, 16B and 16C show the simulated E-field distribution associated with the MTM antenna shown in FIGS. 13-14, at 3.8 GHz, 5 GHz and 8 GHz, respectively.
Figure 16B:
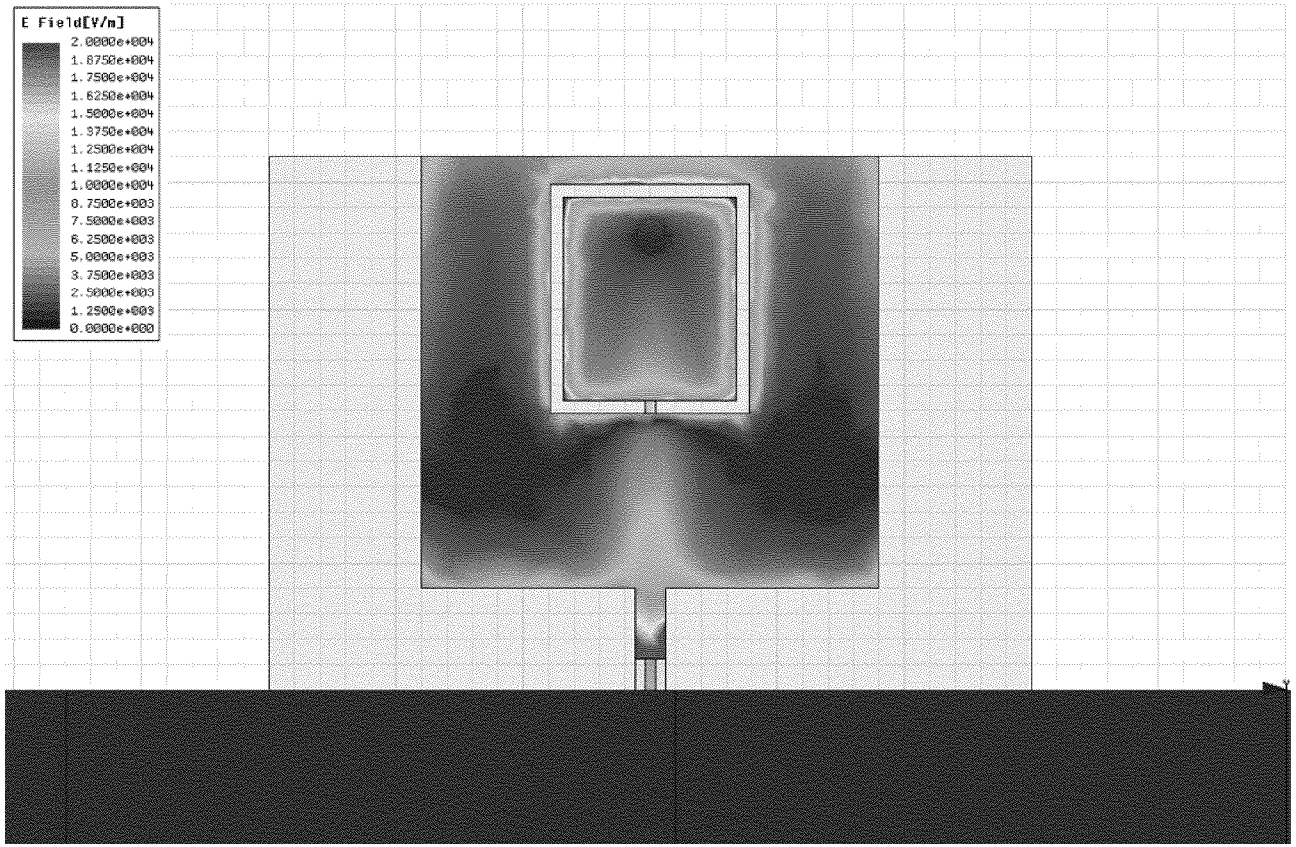
Figure 16C:
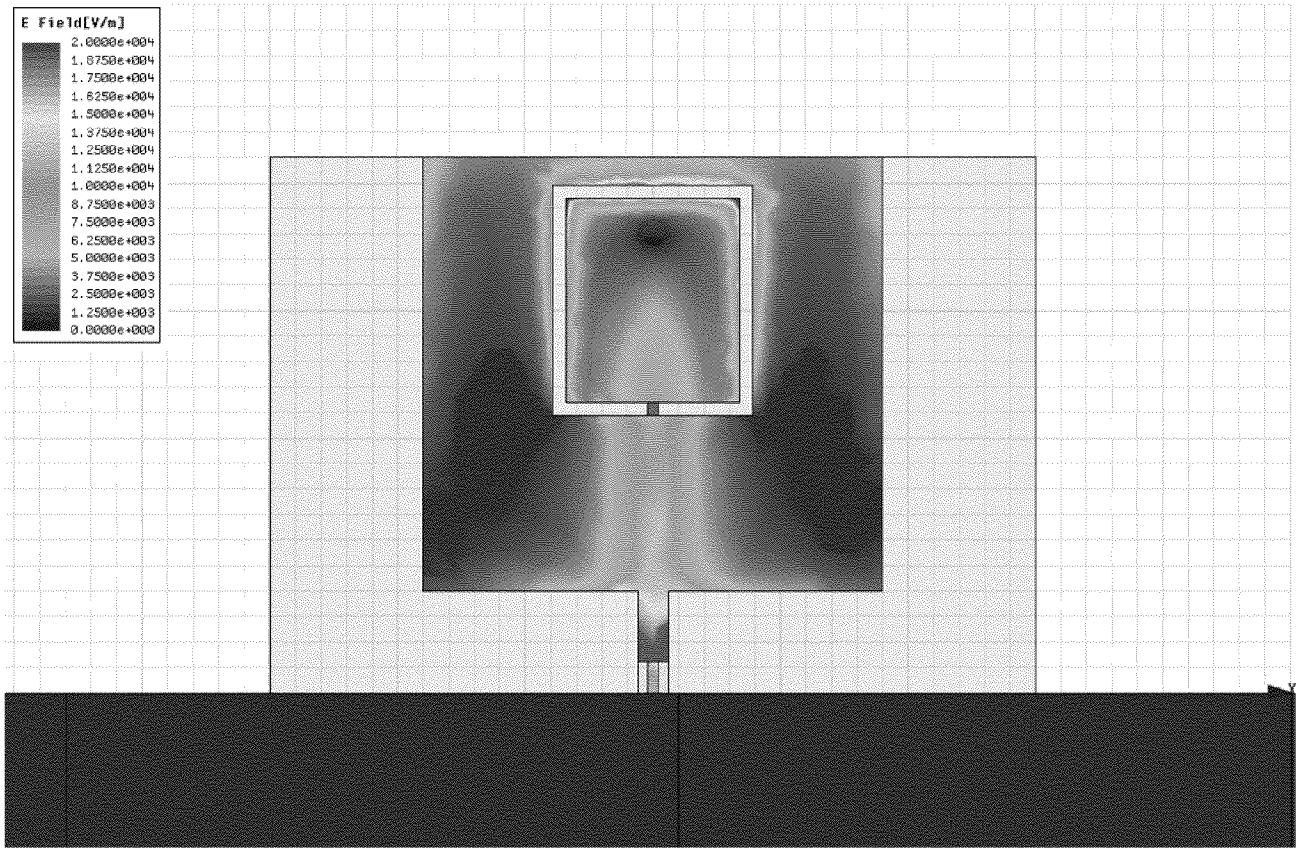

FIGS. 16A, 16B and 16C show the simulated E-field distribution associated with the MTM antenna shown in FIGS. 13-14, at 3.8 GHz, 5 GHz and 8 GHz, respectively. At 3.8 GHz, as shown in FIG. 16A, the E field is strong around the entire rectangular loop of the coupling gap, providing a CL value that gives rise to the well-matched LH resonance. At 5 GHz, as shown in FIG. 16B, the E field is strong at the corners of the rectangular loop, providing another CL value that gives good matching even at the frequency away from the LH resonance. At 8 GHz, as shown in FIG. 16C, the strong E-field is located along the feed line and the region extended into the launch pad and cell patch, providing the mono-pole type RH resonance.

Figure 17A:
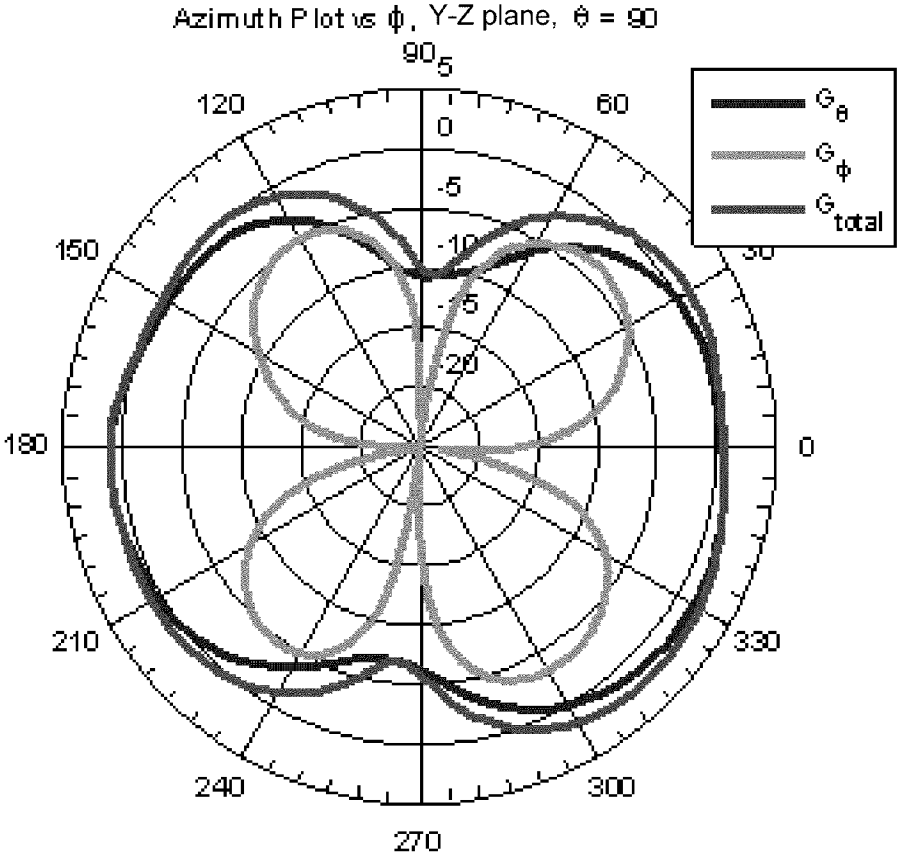
FIGS. 17A and 17B show the measured radiation patterns for 3.3 GHz and 4.5 GHZ, respectively.
Figure 17B:
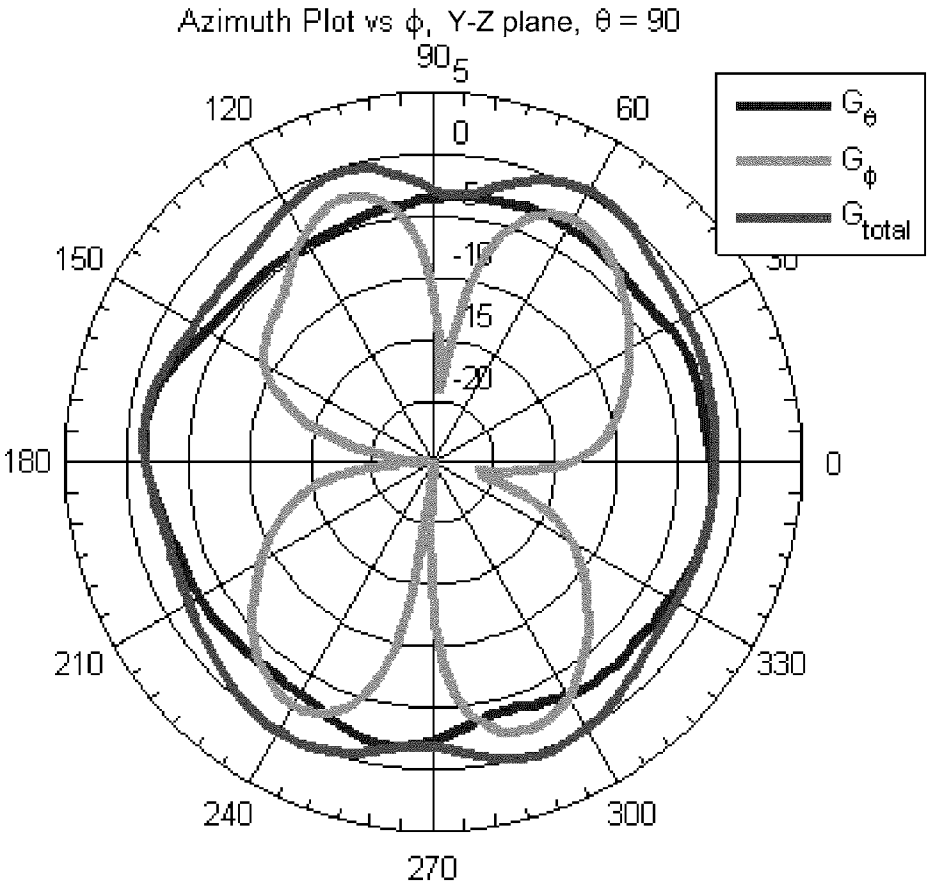

The MTM antenna shown in FIGS. 13A-14B is configured to be symmetric with respect to the X-Z plane cutting through the longitudinal center line of the via line 1328. A 360-degree radiation pattern on the Y-Z plane, which is perpendicular to the X-Y plane of the antenna structure, can be obtained due mainly to the symmetric structure, making it suitable for laptop wireless communications. FIGS. 17A and 17B show the measured radiation patterns for 3.3 GHz and 4.5 GHZ, respectively. These radiation patterns have a 360-degree coverage on the Y-Z plane and may be used to achieve a close approximate of an omnidirectional radiation pattern or a substantially omnidirectional radiation pattern.

Figure 18A:
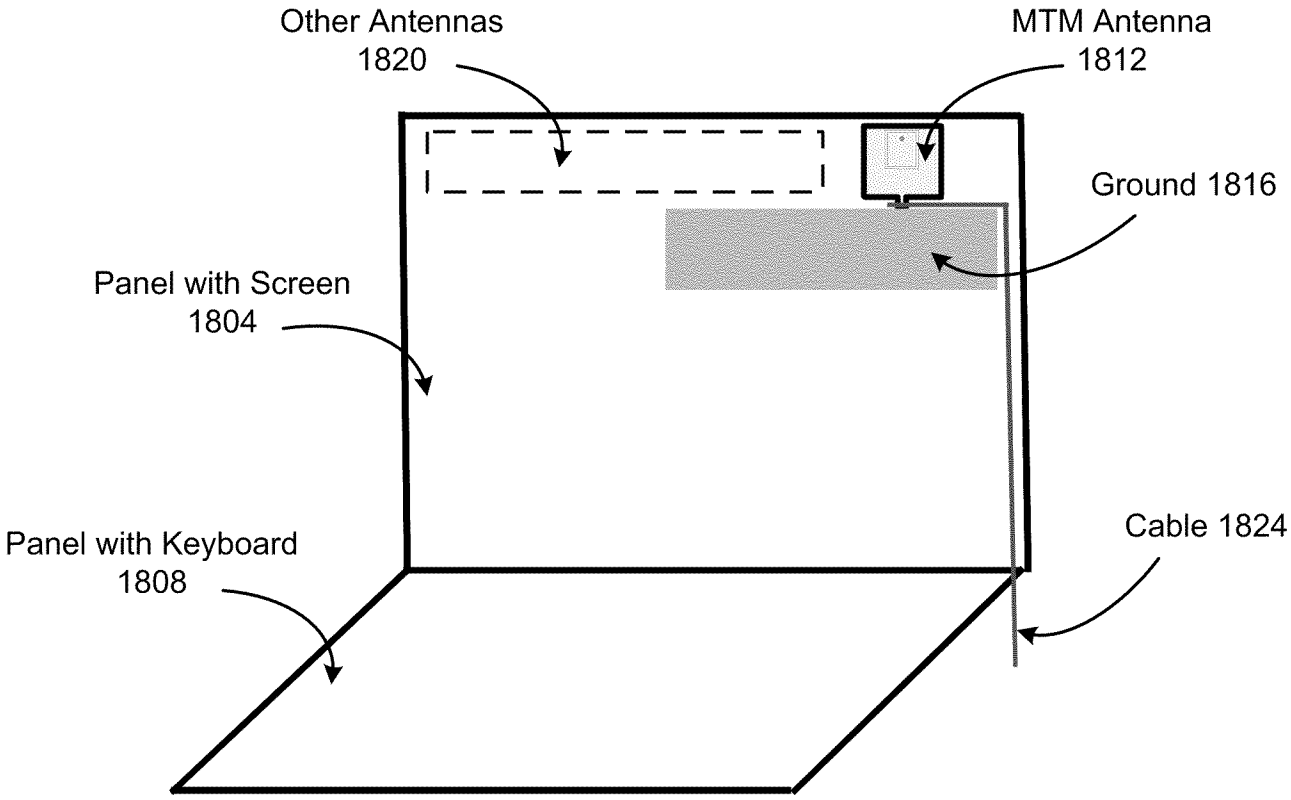
FIG. 18A shows an exemplary antenna positioning that gives good efficiency when a laptop is open.

FIG. 18A shows an example for using the above MTM antenna in a laptop computer. The MTM antenna is selectively positioned on the screen panel of the laptop computer to provide good efficiency when a laptop is open. The panel with screen 1804 is rotated from the panel with keyboard 1808 and includes the MTM antenna 1812 inside a plastic housing, for example, on the surface of the panel. The ground 1816 is provided directly below the MTM antenna 1812. A copper tape connector can be used and attached to the inner side of the housing. A cable, such as a UFL cable, is connected to the MTM antenna 1812 to transmit or receive signals. One or more additional antennas 1820 can be configured to cover WAN, LAN and other operation ranges and be routed to corresponding PCI cards. The antennas 1820 can be MTM antennas or non-MTM antennas. In this exemplary antenna positioning, the MTM antenna 1812 is placed at the same level as the additional antennas 1820.

Figure 18B:
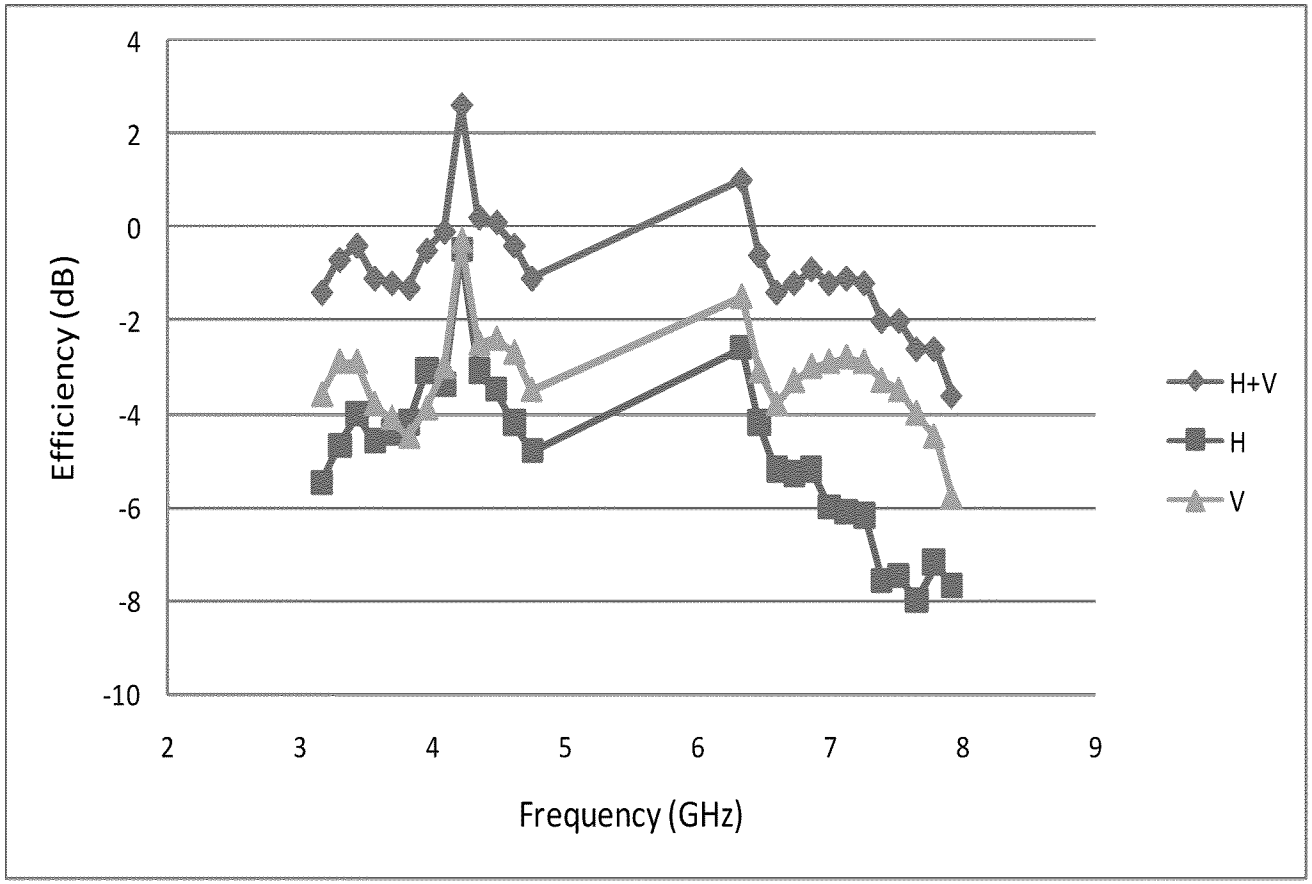
FIG. 18B shows the efficiency measured with the antenna positioning in the laptop as shown in FIG. 18A.
Figure 19A:
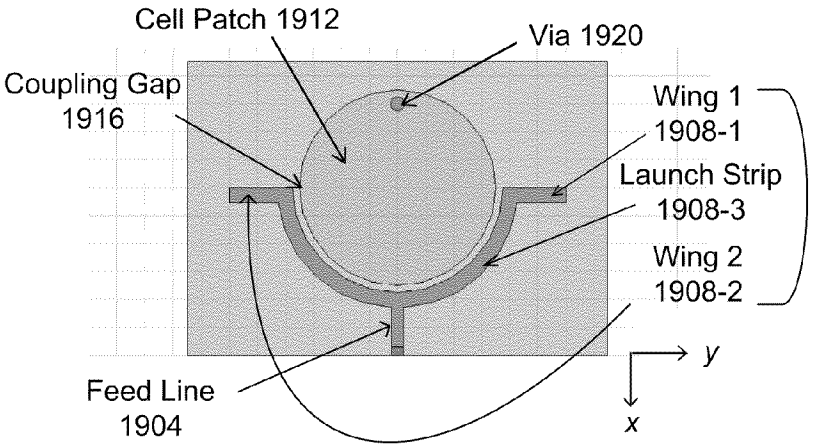
FIGS. 19A-19D show another example of an MTM antenna designed for very wideband operations, illustrating the top view of the top layer, top view of the bottom layer, side view and 3D view, respectively.
Figure 19C:
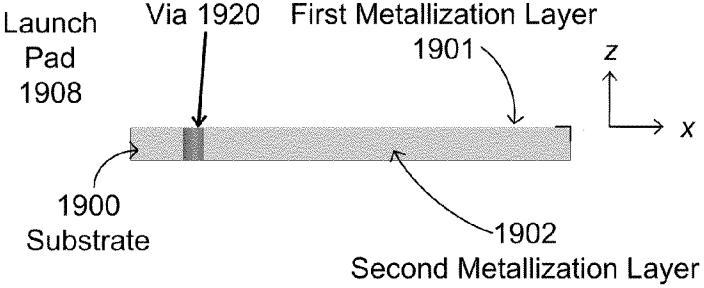
Figure 19D:
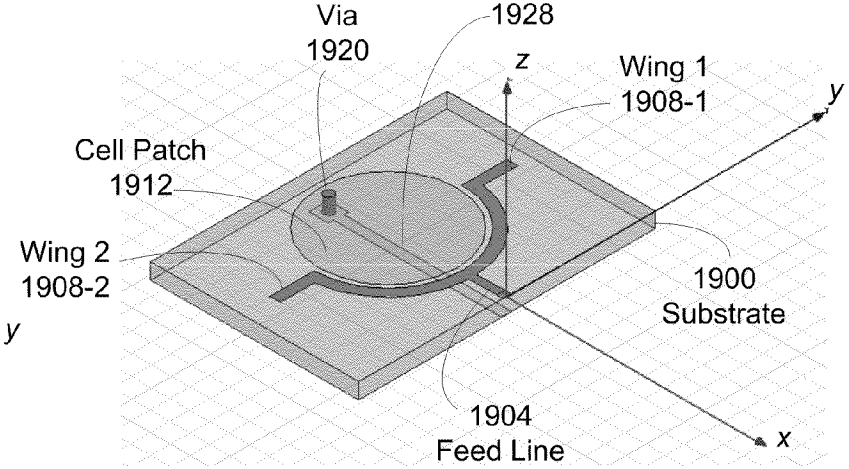
Figure 19B:
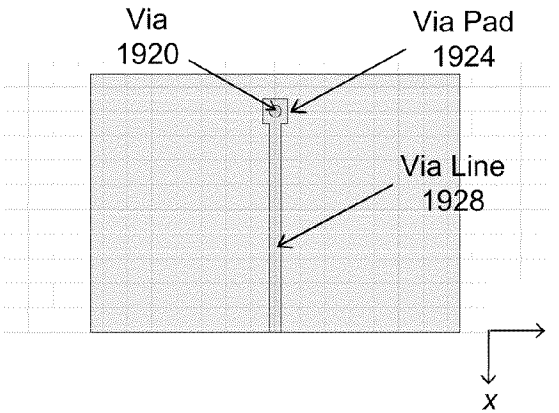

FIG. 18B shows the efficiency measured with the antenna positioning in the laptop as shown in FIG. 18A. The efficiency values in dB are plotted separately for the vertical polarization (solid line with triangles), the horizontal polarization (solid line with squares) and the total (solid line with diamonds). It can be seen that the vertical component is dominant and has the efficiency close to or better than the target value of −3 dB over the range of 3-8 GHz.

In various implementations, the above MTM antenna can be designed to connect a meander line to the feed line to induce an RH resonance at a low frequency. Furthermore, the shapes and dimensions of the cell patch and launch pad, in particular, can be varied to manipulate the non-linear coupling (CL), thereby to engineer the bandwidth and matching for UWB applications. For example, the launch pad can be shaped to have an opening that surrounds only part of the cell patch, e.g., the lower part of the cell patch, instead of entirely surrounding the cell patch as shown in FIGS. 13-14. This design leaves part of the cell patch outside the opening of the launch pad. The overall shape can be chosen to be triangle, polygonal, or any other shape, or a combination of different shapes.

FIGS. 19A-19D show another example of an MTM antenna designed for wideband operations, illustrating the top view of the top layer, top view of the bottom layer, side view and 3D view, respectively. A spatial variation in the launch pad along the gap is implemented in this example to effectuate desired spatially varying electromagnetic coupling that provides impedance matching for different operating frequencies over a wideband. This MTM antenna structure includes a substrate 1900 having a first surface and a second surface opposite to the first surface, a first metallization layer (top layer) 1901 formed on the first surface, and a second metallization layer (bottom layer) 1902 formed on the second surface, where the two metallization layers 1901 and 1902 are patterned to have two or more conductive parts. At least one conductive via 1920 is formed in the substrate 1900 and connects one conductive part in the first metallization layer 1901 to another conductive part in the second metallization layer 1902. These conductive parts include a feed line 1904, a launch pad 1908, a cell patch 1912, a via pad 1924 and a via line 1928 in the present MTM antenna structure shown in FIGS. 19A-19D. The feed line 1904 conducts RF signals between the antenna circuit and the MTM antenna. One end of the feed line 1904 can be configured to connect to a CPW feed formed on the top surface of substrate 1900. The CPW feed can be formed in a top ground plane that is formed in the top layer, separated from the conductive parts and paired with a bottom ground plane, which is formed in the bottom layer, below the top ground plane and separated from the via pad 1920. Alternatively, the MTM antenna can be fed with a CPW feed that does not require a ground plane on a different layer, a probed patch or a cable connector. The other end of the feed line 1904 is connected to the launch pad 1908 to direct a signal to or receive a signal from the cell patch 1912 through a coupling gap 1916. In this example, the cell patch 1912 is circular in shape. The launch pad 1908 includes a launch strip 1908-3, which is semicircular in shape, and two wings 1908-1 and 1908-2 attached at the respective ends of the semicircular launch strip 1908-3. These two wings 1908-1 and 1908-2 are positioned to point away from the center of the circular cell patch 1912. The coupling gap 1916 is thus non-linear in shape, semi-circularly surrounding the cell patch 1912. Additional coupling is provided between each wing and the cell patch 1912, varying from strong to weak as moving away from the portion close to the cell patch 1912 to the distal end of the wing. The via 1920 is formed in the substrate to connect the cell patch 1912 in the top layer to the via pad 1924 in the bottom layer. The via line 1928 is formed in the bottom layer to connect the via pad 1924, hence the via 1920 and the cell patch 1912, to the bottom ground plane. These conductive parts and the substrate together form a MTM antenna structure with the CRLH properties.

Figure 20B:
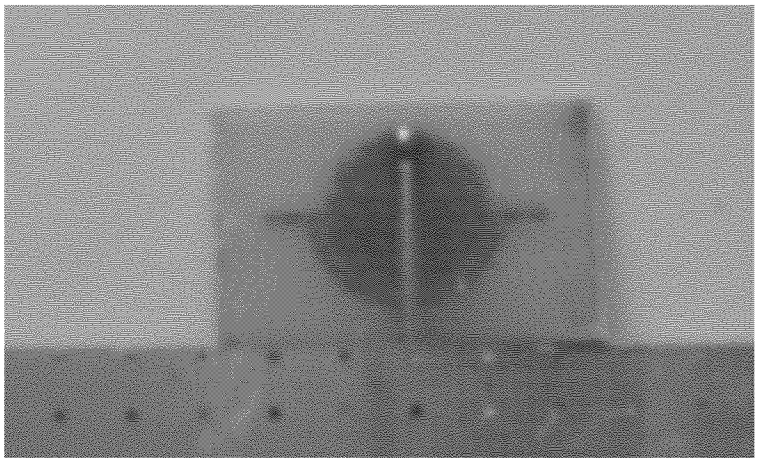
FIGS. 20A and 20B show the photos of a sample of the MTM antenna shown in FIGS. 19A-19D, showing the top view of the top layer and bottom view of the bottom layer, respectively.
Figure 20A:
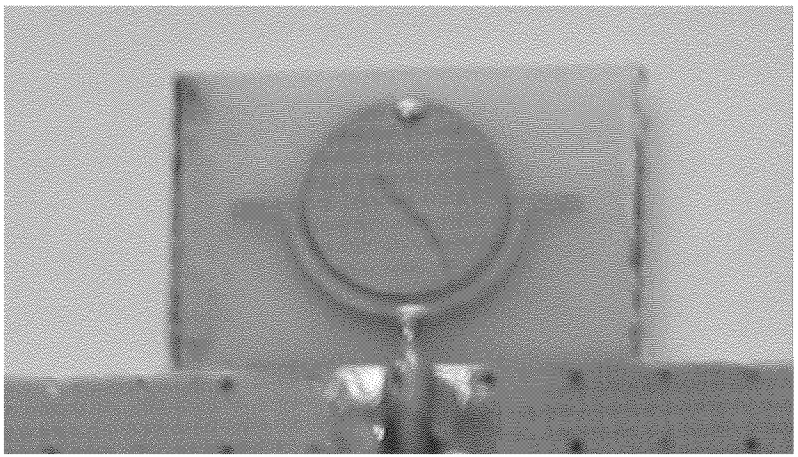

FIGS. 20A and 20B show the photos of a sample of the MTM antenna shown in FIGS. 19A-19D, showing the top view of the top layer and bottom view of the bottom layer, respectively. This antenna is mounted on a ground plane with the size of 80 mm×50 mm and fed by use of a coaxial cable. The design parameters for fabricating this MTM antenna are as follows. The substrate is FR-4 with permittivity of 4.4 and thickness of 0.79 mm. The overall height of the antenna is 9.5 mm and the width is 10.9 mm. The feed line 1904 is 1.5 mm in length and 0.4 mm in width. The cell patch 1912 has a circular shape with a radius of 3.5 mm. The semicircular launch strip 1908-3 has an inner radius of 3.75 mm and an outer radius of 4.32 mm. Each of the wings 1908-1 and 1908-2 has a length of 1.68 mm and a width of 0.55 mm. A 0.25 mm gap is provided between the semicircular launch strip 1908-3 and the cell patch 1912. The via line 1928 is 9.5 mm long and has a width of 0.5 mm. The via pad 1924 is square with a side length of 1 mm. The structures in the top and bottom layers are interchangeable.

Figure 21:
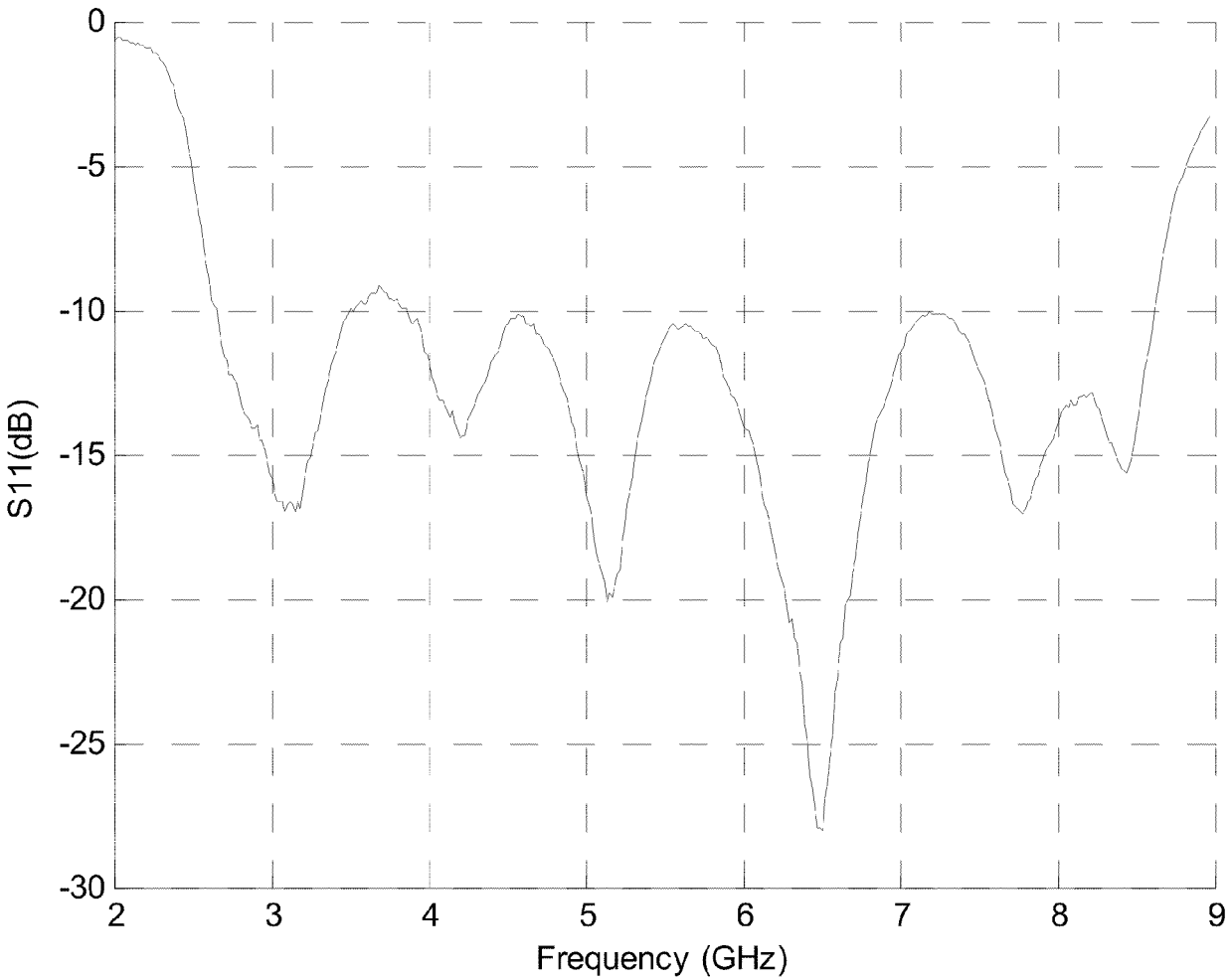
FIG. 21 shows the measured return loss of the MTM antenna shown in FIGS. 19-20.

FIG. 21 shows the measured return loss of the MTM antenna shown in FIGS. 19-20. It can be seen that this antenna radiates efficiently from ~2.5 GHz to ~8.5 GHZ, exhibiting the return loss close to or better than −10 dB for this wide frequency range. Thus, this MTM antenna structure provides the capability suitable for UWB operations, in particular, for the WPAN operation (3-8 GHz).

The analysis using the CRLH unit cells indicates that the electromagnetic coupling between the cell patch 1912 and the launch pad 1908 contributes to the LH series capacitance (CL). The spatial variation of the coupling gap 1916 realized by the structure, in which the launch strip 1908-3 semicircularly surrounds the cell patch 1912 and the two wings 1908-1 and 1908-2 are positioned to point away from the center of the cell patch 1912, provides the spatial variation of the electromagnetic coupling. Matching is determined by the impedance expressed as in Eq. (2), in which the CL term is dominant in the low frequency region. Unlike a structure with a linear coupling geometry with a fixed gap width, where the electromagnetic coupling does not vary spatially, the CL value is frequency dependent due to the spatially varying coupling in the present MTM structure. Specifically, as the frequency changes, the region of the effective coupling in the structure changes, thereby providing different but finite CL values at different frequencies. This indicates enhancement of impedance matching over a frequency range wider than that with a linear coupling geometry with a fixed gap width. The low band including the LH resonance is thus broadened, and together with the high band including the RH resonance (mono-pole type resonance) gives rise to good matching over a very wideband with a bandwidth ranging from 5 to 8 GHz, for example.

Figure 22A:
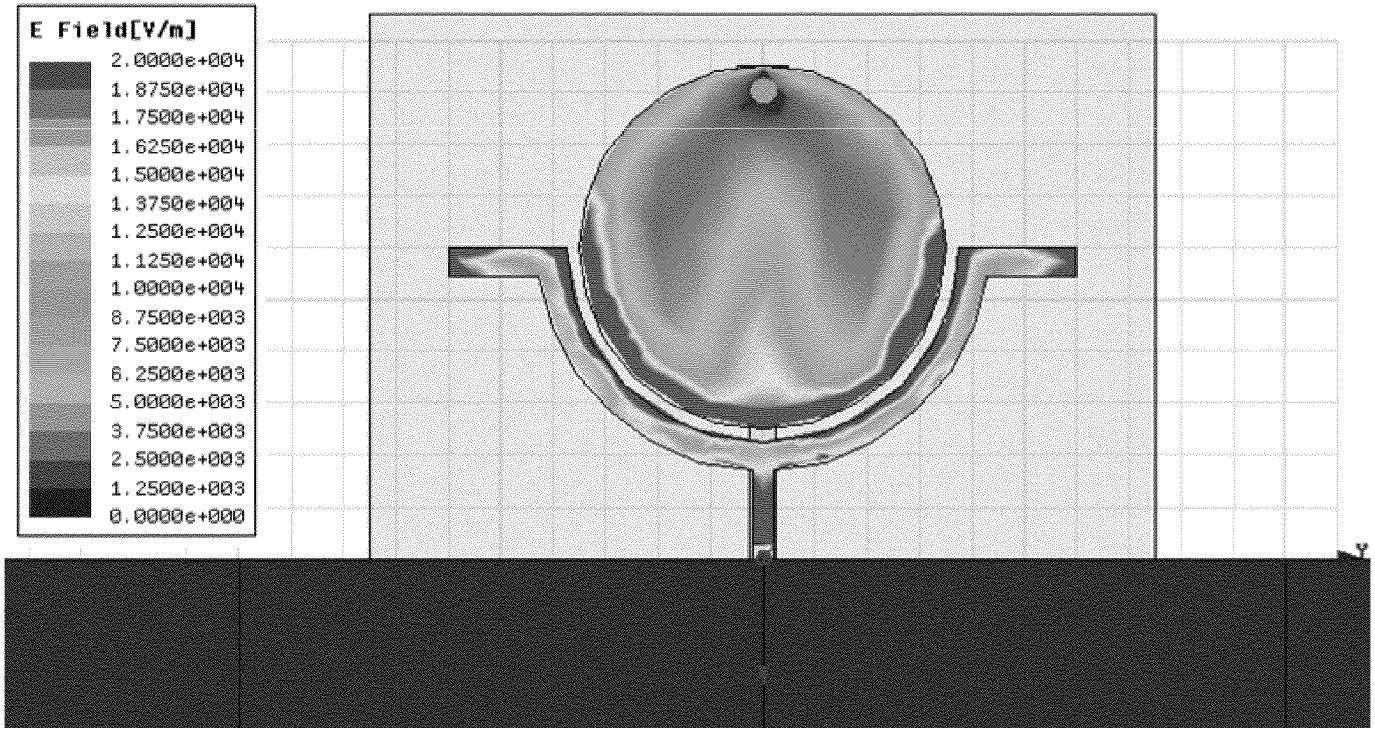
FIGS. 22A, 22B and 22C show the simulated E-field distribution associated with the MTM antenna shown in FIGS. 19-20 at 3.2 GHz, 5 GHz and 8 GHz, respectively.
Figure 22B:
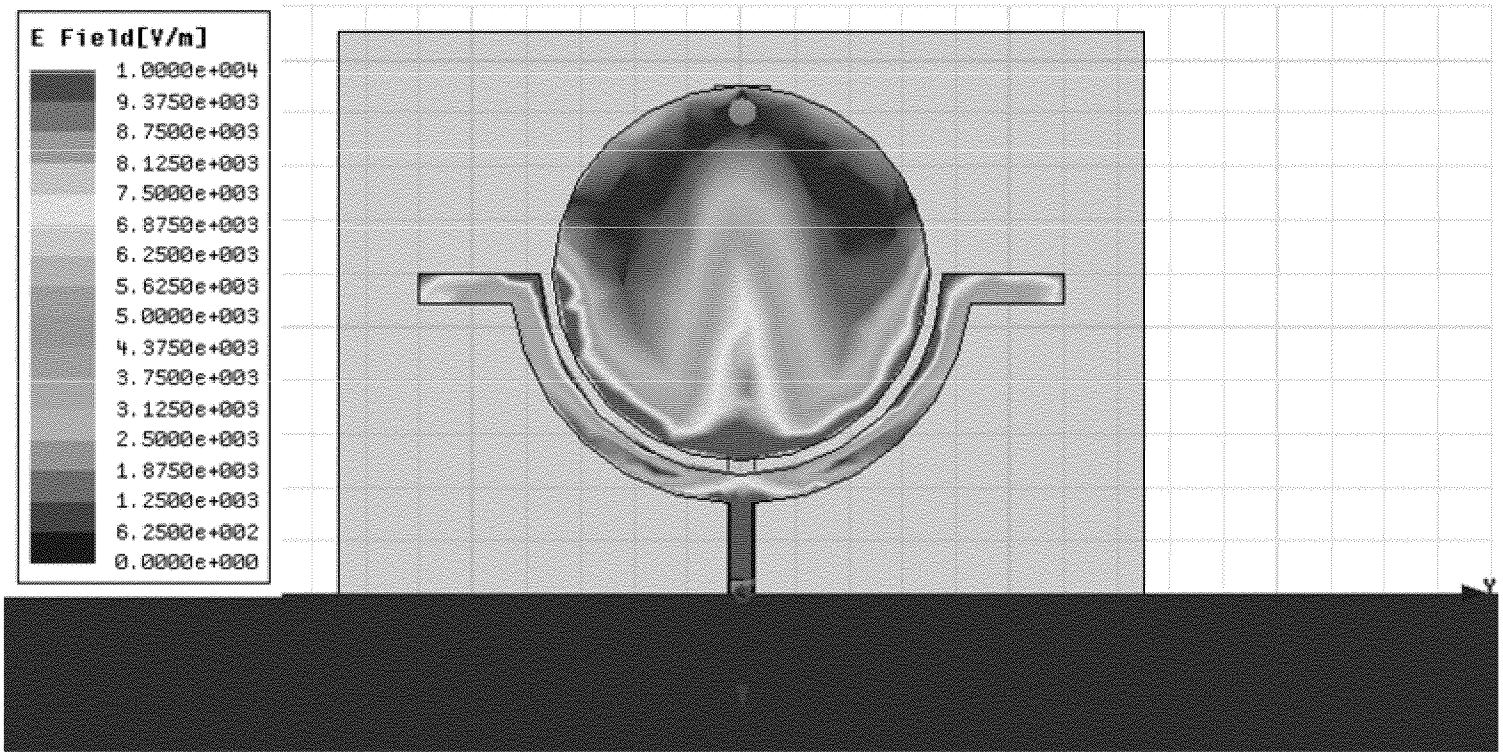
Figure 22C:
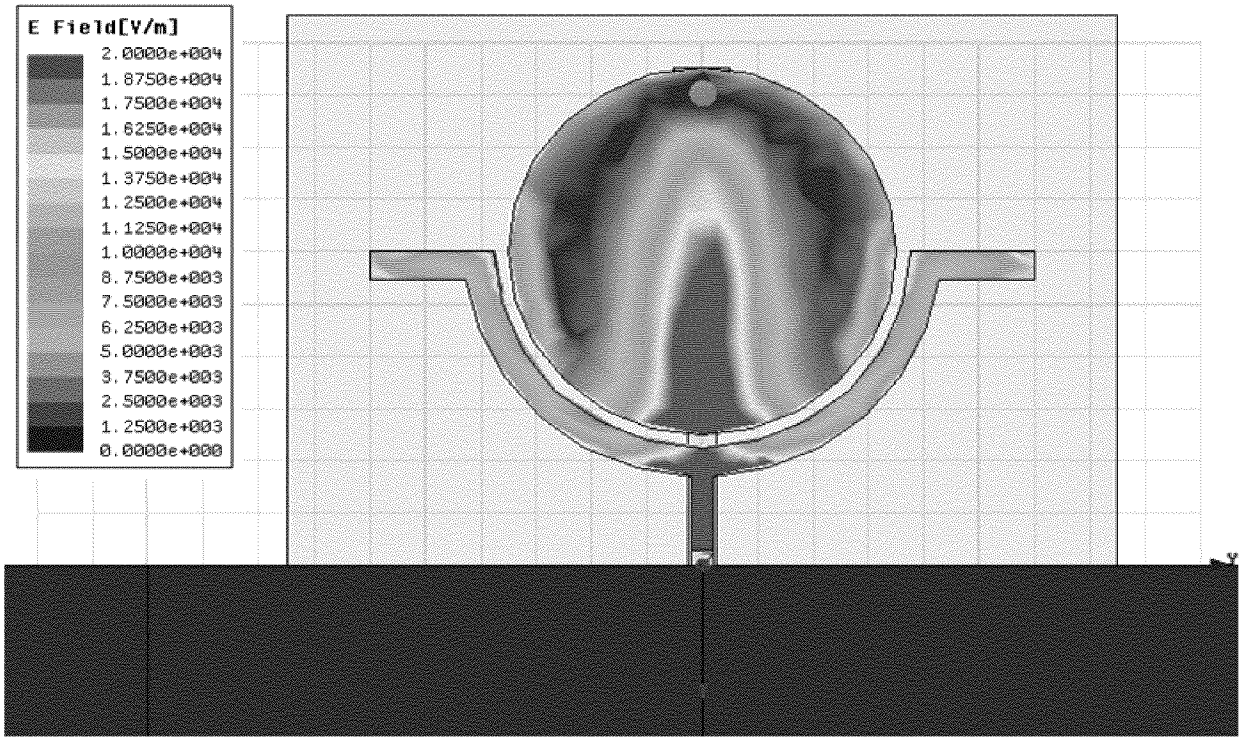

FIGS. 22A, 22B and 22C show the simulated E-field distribution associated with the MTM antenna shown in FIGS. 19-20 at 3.2 GHz, 5 GHz and 8 GHz, respectively. At 3.2 GHz, as shown in FIG. 22A, the E-field is strong at the wing 1 1908-1, wing 2 1008-2, the lower edge of the cell patch 1912 and the upper edge of the launch strip 1908-3. Thus, the entire launch pad 1908, which has the launch strip 1908-3 and the wings 1908-1 and 1908-2 attached at the respective ends of the semicircular launch strip 1908-3, is electromagnetically coupled to the cell patch 1912, providing a CL value that gives rise to the well-matched LH resonance at this frequency. Especially noteworthy is the coupling between the wings 1908-1 and 1908-2 and the cell patch 1912; each wing acts as an additional radiator as well as tuning factor to the antenna impedance, enhancing the matching in the low frequency region. At 8 GHz, as shown in FIG. 22C, the strong E-field is located along the feed line and the region extended into the launch pad and cell patch, providing the mono-pole type RH resonance at this frequency. At 5 GHz, as shown in FIG. 22B, the E-field distribution has a pattern in between that at 3.2 GHz and that at 8 GHz, providing the combination of the LH and RH characteristics. The overall coupling between the cell patch 1912 and the launch pad 1908 is shifted lower in position as compared to that for 3.2 GHz in FIG. 22A, providing another CL value that gives good matching even at the frequency away from the LH resonance.

Figure 23A:
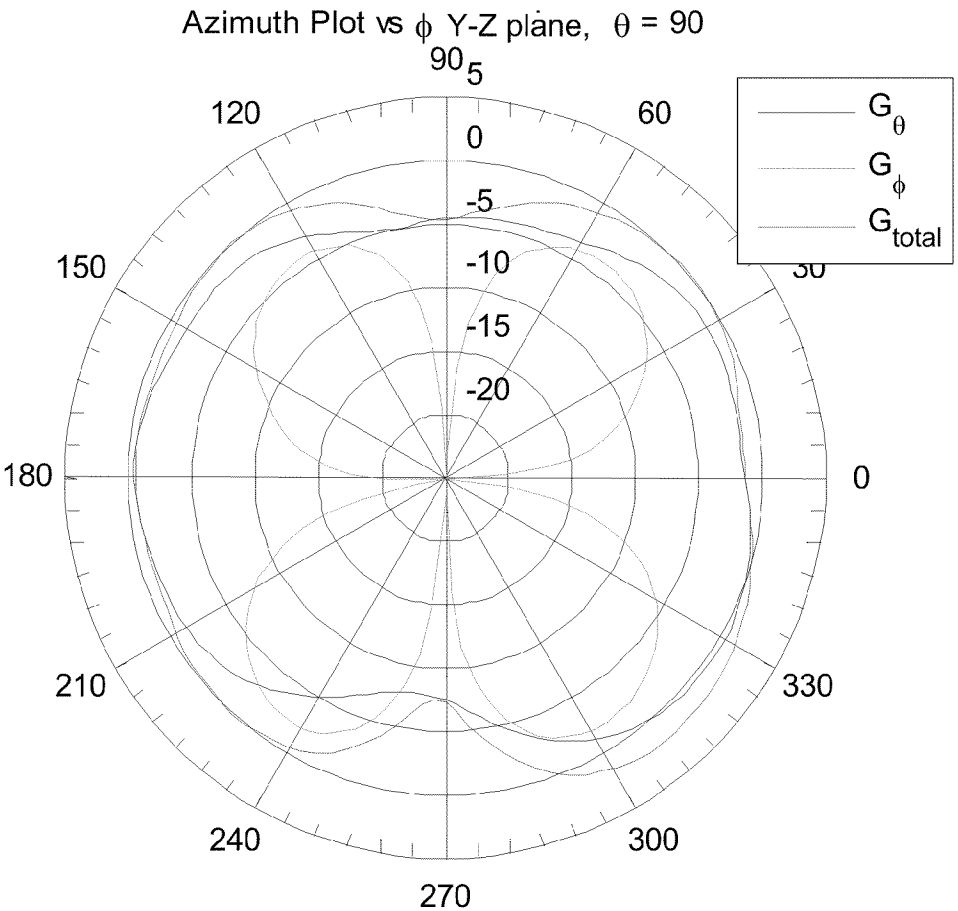
FIGS. 23A and 23B show the radiation patterns associated with the MTM antenna shown in FIGS. 19-20 at 3.3 GHz and 4.76 GHz, respectively.
Figure 23B:
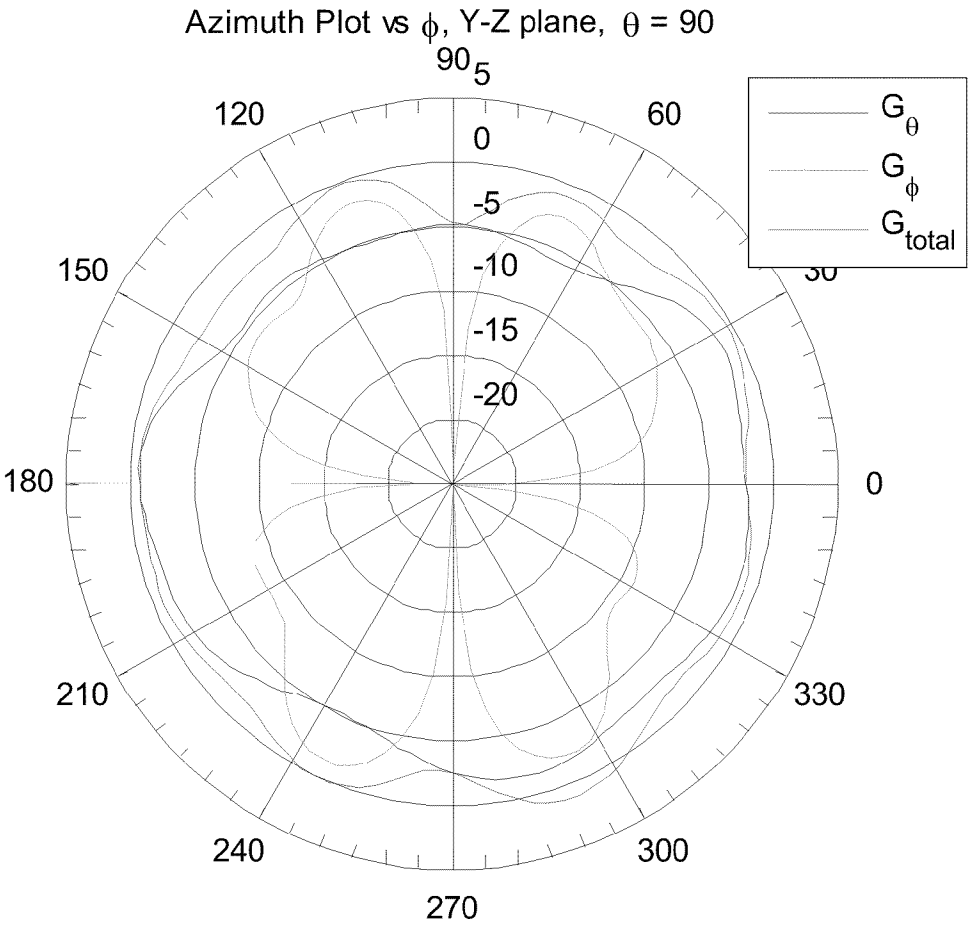

The MTM antenna shown in FIGS. 19-20 is configured to be symmetric with respect to the X-Z plane cutting through the longitudinal center line of the via line 1928. Omnidirectional radiation patterns on the Y-Z plane, which is perpendicular to the plane of the antenna structure, can be obtained due mainly to the symmetric structure, making it suitable for laptop wireless communications. FIGS. 23A and 23B show the radiation patterns associated with the MTM antenna shown in FIGS. 19-20 at 3.3 GHz and 4.76 GHz, respectively, demonstrating the substantially omnidirectional coverage in the azimuthal plane (Y-Z plane).

Figure 24:
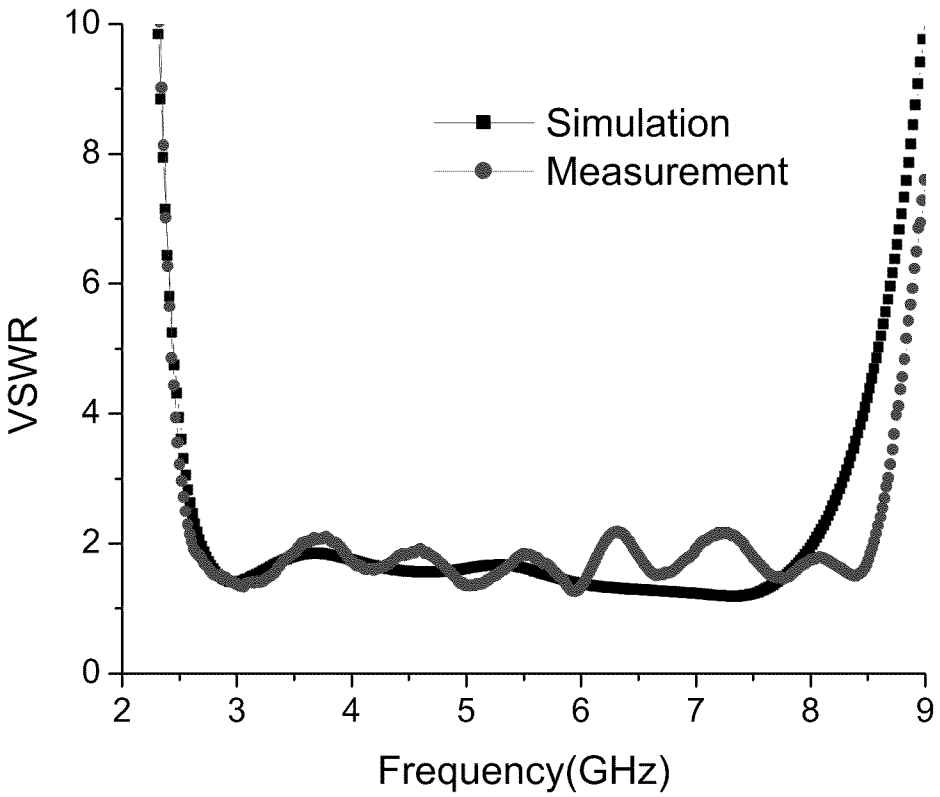
FIG. 24 shows the simulated and measured Voltage Standing Wave Ratio (VSWR) of the MTM antenna shown in FIGS. 19-20, indicated by squares and circles, respectively.

FIG. 24 shows the simulated and measured Voltage Standing Wave Ratio (VSWR) of the MTM antenna shown in FIGS. 19-20, indicated by squares and circles, respectively. VSWR represents the measure as to how good the matching is, with VSWR<2 being a general requirement. The simulated and measured VSWR curves both show that the antenna bandwidth with good matching is wide enough to cover the WPAN band of 3-8 GHz.

Figure 25:
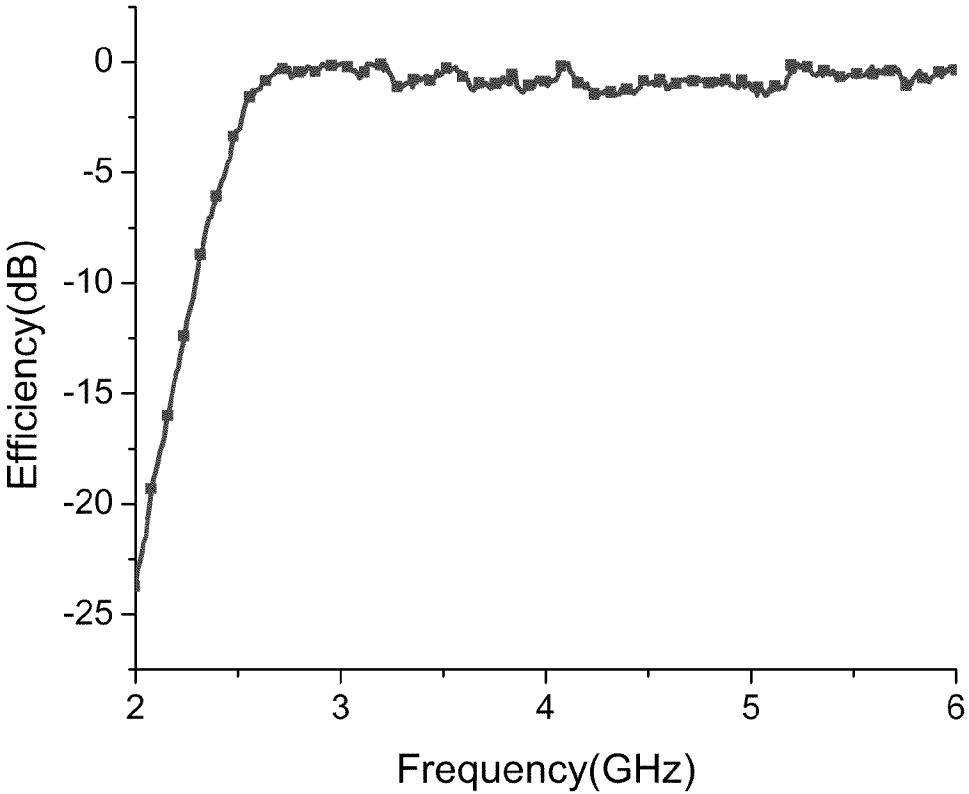
FIG. 25 shows the measured efficiency of the MTM antenna shown in FIGS. 19-20.

FIG. 25 shows the measured efficiency of the MTM antenna shown in FIGS. 19-20. High efficiency above −3 dB is obtained over the WPAN band.

Figure 26A:
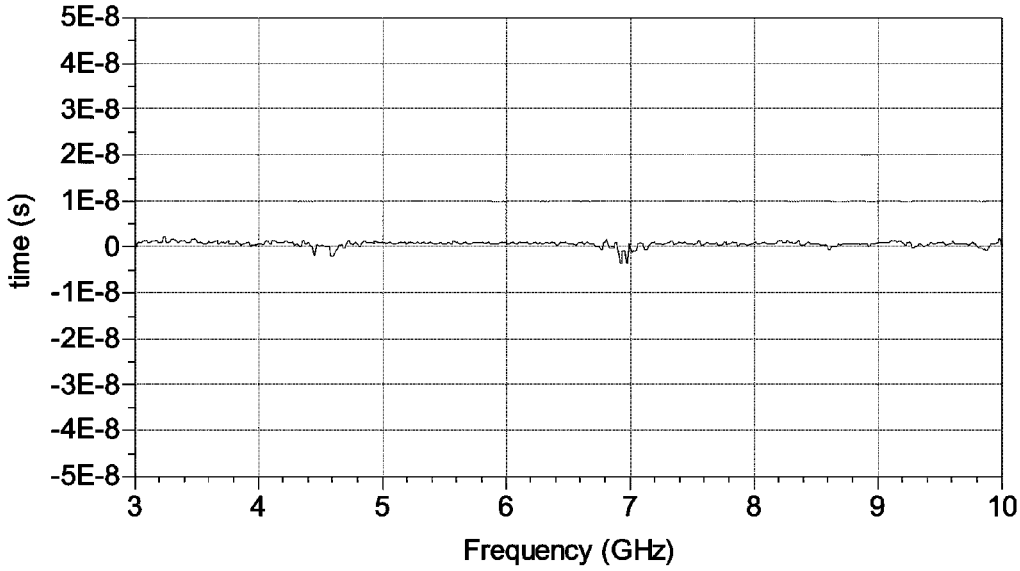
FIGS. 26A and 26B show the group delay curves measured for the square MTM antenna shown in FIGS. 13-14 and the circular MTM antenna shown in FIGS. 19-20, respectively.
Figure 26B:
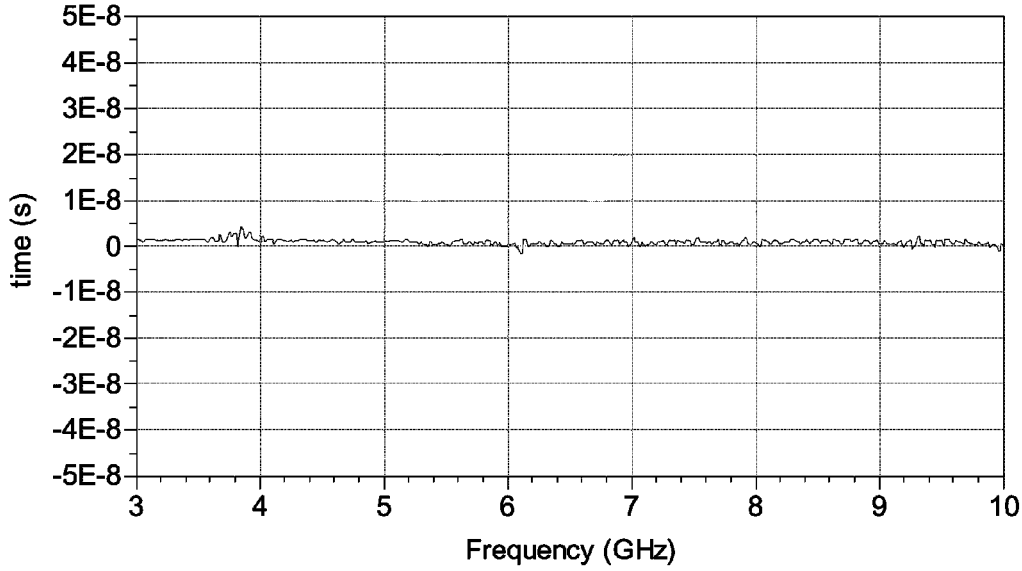

FIGS. 26A and 26B show the group delay curves measured for the rectangular MTM antenna shown in FIGS. 13-14 and the circular MTM antenna shown in FIGS. 19-20, respectively. This measurement was carried out by placing two identical MTM antennas face-to-face separated by 30 mm.

The group delay represents the degree of distortion of pulse signals. The group delay of these two MTM antennas is about 1 nano second and stable across the entire measured frequency range of 3-10 GHz. This indicates that both antennas have very small distortion in time domain.

A possible design variation to the circular MTM antenna shown in FIGS. 19-20 is to replace the circular shape of the cell patch with an elliptical shape, and correspondingly replace the semicircular portion of the launch pad with a semi-elliptical shape with wings attached at the two ends. Another variation is to extend the semicircular portion of the launch pad to surround more or less than the lower semicircular edge (i.e., more or less than 180° coverage) of the cell patch. Yet another variation is to have the cell patch with only the lower half circle instead of a full circular shape. The wings act as additional radiators and tuning factors in various modifications as well. The shapes and dimensions of the launch pad (including the wings and launch strip) and cell patch, in particular, can be varied to manipulate the non-linear coupling (CL), thereby to engineer the bandwidth and matching for UWB applications. A possible design variation to widen the band width toward the lower frequency region is to have two or more cell patches capacitively coupled to the single feed line. This may generate multiple LH resonances at low frequencies. Another variation is to connect a meander line to the feed line to induce an RH resonance at a low frequency.

While this document contains many specifics, these should not be construed as limitations on the scope of an invention or of what may be claimed, but rather as descriptions of features specific to particular embodiments of the invention. Certain features that are described in this document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or a variation of a subcombination.

Only a few implementations are disclosed. Variations and enhancements of the described implementations and other implementations can be made based on what is described and illustrated in this document.

What is claimed is:

1. An antenna device based on a composite right and left handed (CRLH) metamaterial antenna structure, comprising:

a substrate having a first surface and a second surface opposite to the first surface;

a cell patch formed on the first surface;

a launch pad formed on the first surface and separated from the cell patch by a gap, the launch pad being electromagnetically coupled to the cell patch through the gap to direct a signal to or from the cell patch;

a feed line formed on the first surface and coupled to the launch pad to conduct the signal to or from the cell patch;

a via line formed on the second surface and coupled to a ground electrode outside a footprint of the cell patch on the second surface; and a via formed in the substrate to couple the cell patch on the first surface to the via line on the second surface;

wherein the substrate, the feed line, the cell patch, the launch pad, the via line, and the via form a CRLH metamaterial antenna structure, wherein the cell patch, the launch pad and the gap are structured to effectuate spatially varying electromagnetic coupling that provides impedance matching for different operating frequencies over a wideband; and wherein the launch pad includes an opening in which the cell patch is located, the launch pad configured to entirely surround the cell patch in a region defined by the opening.

2. The antenna device as in claim 1, wherein the cell patch is rectangular in shape.

3. The antenna device as in claim 1, wherein the cell patch is triangular in shape.

4. The antenna device as in claim 1, wherein the cell patch is polygonal in shape.

5. The antenna device as in claim 1, wherein the cell patch is elliptical in shape and the launch pad includes a curved conductive strip line adjacent to part of the cell patch.

6. The antenna device as in claim 1, wherein the cell patch is circular in shape and the launch pad includes a curved conductive strip line adjacent to part of the cell patch.

7. The antenna device as in claim 1, wherein the cell patch is semicircular in shape and the launch pad includes a curved conductive strip line adjacent to part of the cell patch.

8. The antenna device as in claim 1, wherein the launch pad includes:

a strip portion that at least partially surrounds a portion of the cell patch; and wing portions that are attached at two ends of the strip portion, respectively, and are extended to point away from the cell patch.

9. The antenna device as in claim 1, wherein the gap is configured to vary spatially.

10. The antenna device as in claim 1, wherein the cell patch, the launch pad and the gap are structured to effectuate spatially varying electromagnetic coupling that provides impedance matching for different operating frequencies over a ultra wideband (UWB) which covers 3 GHz to 10.6 GHz.

11. The antenna device as in claim 10, wherein the UWB includes a Wireless Personal Area Network (WPAN) band.

12. The antenna device as in claim 1, wherein the feed line, the launch pad, the cell patch, the via, and the via line are configured to be symmetric with respect to a plane perpendicular to the first and second surfaces and cutting along a longitudinal center line of the via line.

13. The antenna device as in claim 12, wherein the antenna device forms a substantially omnidirectional radiation pattern.

14. A method for wideband antenna operations based on a composite right and left handed (CRLH) metamaterial antenna structure, comprising:

providing an antenna including a CRLH metamaterial structure that includes:

a cell patch;

a launch pad separated from the cell patch by a gap and electromagnetically coupled to the cell patch through the gap to direct a signal to or from the cell patch, the launch pad including an opening in which the cell patch is located, the launch pad configured to entirely surround the cell patch in a region defined by the opening;

a via line formed on a surface of the antenna opposite the cell patch and coupled to a ground electrode on the surface opposite the cell patch and outside a footprint of the cell patch; and a via to couple the cell patch on a first surface of the antenna to the via line on a second surface of the antenna; and structuring the cell patch, the launch pad and the gap to effectuate spatially varying electromagnetic coupling that provides impedance matching for different operating frequencies over a wideband.

15. The method as in claim 14, wherein the structuring the cell patch, the launch pad and the gap to effectuate spatially varying electromagnetic coupling includes providing a spatial variation in the gap.

16. The method as in claim 14, wherein the structuring the cell patch, the launch pad and the gap to effectuate spatially varying electromagnetic coupling includes providing a spatial variation in the launch pad near the gap.

17. The method as in claim 14, wherein the structuring the cell patch, the launch pad and the gap to effectuate spatially varying electromagnetic coupling includes providing a spatial variation in the gap and a spatial variation in the launch pad near the gap.

18. The method as in claim 14, wherein the structuring of the cell patch, the launch pad and the gap to effectuate spatially varying electromagnetic coupling includes providing a spatial variation in the cell patch near the gap.

19. An antenna device based on a composite right and left handed (CRLH) metamaterial antenna structure, comprising:

a substrate having a first surface and a second surface opposite to the first surface; and first and second metallization layers formed on the first and second surfaces, respectively, to include a cell patch formed on the first surface, a launch pad formed on the first surface and separated from the cell patch by a gap, a feed line formed on the first surface and coupled to the launch pad to conduct an antenna signal to or from the cell patch, a ground electrode formed on the second surface and located outside a footprint of the cell patch projected onto the second surface, a via line formed on the second surface and coupled to the ground electrode on the second surface, and a via formed in the substrate to couple the cell patch on the first surface to the via line on the second surface;

wherein the substrate, the feed line, the cell patch, the launch pad, the via line, and the via form a CRLH metamaterial antenna structure that receives the antenna signal from the air or transmits the antenna signal into the air via the cell patch and other parts of the CRLH metamaterial antenna structure, wherein the cell patch, the launch pad and the gap in the first metallization layer are structured to have at least one of a spatial variation in a dimension of the gap along the gap, and a spatial variation in either or both of the cell patch and the launch pad along the gap to effectuate spatially varying electromagnetic coupling that provides impedance matching for different operating frequencies over a wideband; and wherein the launch pad includes an opening in which the cell patch is located, the launch pad configured to entirely surround the cell patch in a region defined by the opening.

20. The antenna device as in claim 19, wherein the CRLH metamaterial antenna structure is structured to provide a 360-degree radiation coverage around the CRLH metamaterial antenna structure in receiving the antenna signal from the air or transmitting the antennal signal into the air via the cell patch and other parts of the CRLH metamaterial antenna structure.

21. The antenna device as in claim 19, comprising a conductive meander line connected to the feed line to induce a at least one additional resonance to the CRLH metamaterial antenna structure.

* * * * *